US008253084B2

(12) United States Patent
Toyoda et al.

(10) Patent No.: US 8,253,084 B2
(45) Date of Patent: Aug. 28, 2012

(54) DRAWER TYPE COOKING DEVICE HAVING TURNTABLE MECHANISM

(75) Inventors: Takashi Toyoda, Osaka (JP); Masayuki Iwamoto, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 392 days.

(21) Appl. No.: 12/625,611

(22) Filed: Nov. 25, 2009

(65) Prior Publication Data

US 2010/0133263 A1 Jun. 3, 2010

(30) Foreign Application Priority Data

Nov. 28, 2008 (JP) ..... 2008-304020
Nov. 28, 2008 (JP) ..... 2008-304024
Dec. 4, 2008 (JP) ..... 2008-309521

(51) Int. Cl.
*H05B 6/68* (2006.01)

(52) U.S. Cl. ..... 219/754; 219/722

(58) Field of Classification Search ..... 219/518, 219/722, 752–762
See application file for complete search history.

(56) References Cited

U.S. PATENT DOCUMENTS 5,345,068 A * 9/1994 Hatano et al. ..... 219/722
5,796,082 A 8/1998 Kim
2008/0315739 A1* 12/2008 Hirano ..... 312/330.1

FOREIGN PATENT DOCUMENTS

JP 2520881 Y2 12/1996
JP 2004-61092 A 2/2004
JP 2004-71213 A 3/2004
JP 2005-221081 A 8/2005
JP 3939232 B2 7/2007
JP 4027325 B2 12/2007

* cited by examiner

*Primary Examiner* — Calvin Lee
(74) *Attorney, Agent, or Firm* — Birch, Stewart, Kolasch & Birch, LLP

(57) ABSTRACT

The invention provides a drawer type microwave oven having a turntable functioning as a uniform heating mechanism with a visual effect, while maintaining the ceiling height of a heating chamber and having improved usability. A turntable drive mechanism 40 utilizing a thin deceleration mechanism and a pivot mechanism is disposed in a space 19 formed between a bottom wall 17 of the drawer body 4 and a bottom wall 12 of the heating chamber 3, and a power transmission mechanism is engaged in a detachable manner in conjunction with the movement of the drawer body 4 together with the door. Thus, a drawer type microwave oven capable of performing uniform heating by pivot rotation while maintaining the ceiling height of the heating chamber is realized.

6 Claims, 13 Drawing Sheets

DRAWER TYPE COOKING DEVICE HAVING TURNTABLE MECHANISM

The present application is based on and claims priorities of Japanese patent applications No. 2008-304020 filed on Nov. 28, 2008, No. 2008-304024 filed on Nov. 28, 2008 and No. 2008-309521 filed on Dec. 4, 2008, the entire contents of which are hereby incorporated by reference.

BACKGROUND OF THE INVENTION

1. Field of the Invention

The present invention relates to drawer type cooking devices having a turntable mechanism for heating an object to be cooked in a uniform manner.

The present invention also relates to drawer type cooking devices, wherein a drawer body with a door loading therein an object to be cooked is placed in the interior of the cooking device body and capable of being drawn out therefrom.

2. Description of the Related Art

In the prior art, cooking devices having a drawer body formed integrally with a door and capable of being drawn out to the front side of the cooking device have been proposed. Since this type of drawer type cooking devices can be built into the kitchen cabinet arranged downward of a countertop of a kitchen and installed without occupying the countertop area, it is suitably applied to a kitchen arrangement where multiple cooking devices are disposed spatially. Therefore, drawer type cooking devices have been considered as one type of cooking devices installed in a fitted kitchen or designed kitchen, and the use thereof is spreading especially in the United States.

FIG. 17 shows a perspective view of one example of a cabinet structure to which the cooking device is built in. There are two standard sizes for the width W of the mounting portion of the cabinet, which are 24 inches (approximately 62 cm) and 30 inches (approximately 76 cm). The height of the cabinet is 914 mm, the mounting surface height of the cooker is 483 mm, and the width, height and depth of the opening for loading the cooking device are 721 mm, 375 mm and 597 mm, respectively. The withstand load of the mounting surface is 160 kg or greater. A power supply outlet is disposed at a rear wall of the mounting opening portion. Since drawer type cooking devices have a common heating chamber width formed in the interior thereof and a common drawer body width, the drawer type cooking devices will correspond to the cabinet structure by changing or selecting the width of the door and the width of the outer casing.

The present applicant has proposed in patent document 1 (Japanese patent application laid-open publication No. 2005-221081=Publication of Japanese patent No. 4027325) a drawer type microwave oven as an example of a drawer type heating cooker, comprising a cooking device body having a heating chamber, a drawer body movably disposed within the cooking device body and capable of being drawn out of the heating chamber of the cooking device body, and slide rails for moving the drawer body within the cooking device body, wherein the slide rails are disposed outside the heating chamber, according to which the slide mechanisms can be formed without using components or materials having high heat resistance and flame resistance, and defective discharge via the microwaves can be prevented.

Since the prior art drawer type microwave oven disclosed in patent document 1 (Japanese patent application laid-open publication No. 2005-221081=Publication of Japanese patent No. 4027325) has slide mechanisms disposed on the side wall and the bottom wall of the heating chamber on the outer side of the heating chamber for moving the drawer body linearly, it is difficult to supply the microwaves generated via a high frequency generator through the side wall or the bottom wall of the heating chamber. Therefore, the arrangement adopts a ceiling power supply structure in which a waveguide for introducing microwaves is disposed on a ceiling portion of the body on the outer side of the heating chamber, and microwaves are supplied through the waveguide into the heating chamber.

On the other hand, general mass-produced microwave ovens to be placed on a kitchen counter-top include a turntable-type microwave oven in which a rotating turntable is disposed on the bottom side of the heating chamber as a uniform heating mechanism for heating an object to be heated such as food in a uniform manner, and a turntable having the object to be heated mounted thereon rotated during heating operation. Further, general mass-produced drawer type microwave ovens not capable of adopting turntables adopt a rotating stirrer or a rotating antenna-type microwave oven in which a rotating body having a nonuniform shape such as a metal plate is disposed within the microwave path on the ceiling portion, and the rotating body is rotated during heating operation so as to stir the microwave distribution within the heating chamber.

In order to adopt a turntable as a uniform heating mechanism in drawer type microwave ovens, a rotating turntable must be disposed on the drawer body. However, it is difficult to dispose a driving mechanism to a linearly-movable drawer body and to supply power thereto, and it is also difficult to arrange the turntable and the driving mechanism thereof within the vertically narrow space. Therefore, a rotating antenna as a uniform heating mechanism was arranged within the waveguide disposed on the ceiling surface of the heating chamber, which is a fixed area. In order to adopt this type of uniform heating mechanism, it was necessary to adopt a ceiling surface power supply structure for supplying microwaves through the ceiling into the heating chamber.

However, there have been strong demands from users favoring the traditional turntable structure for a drawer type microwave ovens adopting a turntable enabling to visually confirm the heating operation of the microwave oven. Further, according to a survey carried out by the present applicant to users of drawer type microwave ovens in the United States, it was discovered that many consumers desired the turntable mechanism to be adopted in microwave ovens.

On the other hand, according to another survey, it was discovered that there were strong demands for the ceiling height of the heating chamber of the drawer type microwave oven to be 180 mm or higher, so as to enable mugs of a famous coffee shop chain to be easily placed therein. Therefore, to set the ceiling height of the heating chamber to 180 mm or higher is a priority matter in designing the drawer type microwave oven.

As described, adopting turntables in drawer type microwave ovens has been a top priority technological challenge from the start of development of the drawer type microwave ovens, but it has not been possible for a long time.

One possible structure for adopting a turntable in a drawer type microwave oven is to first dispose a turntable on a bottom surface of the drawer body similar to the prior art microwave oven, and to dispose a rotary motor below the bottom surface of the drawer body as driving mechanism. According to such structure, the rotary motor moves together with the movement of the drawer body, so the mechanism does not require special engagement and disengagement operations.

However, since the area below the bottom surface of the drawer body is arranged within the heating chamber of the microwave oven into which microwaves are irradiated, it is impossible to dispose a rotary motor therein. Thus, it is impossible to dispose a turntable having the prior art structure to the drawer type microwave oven.

Further, since the power line connected to the rotary motor is moved and bent every time the drawer body is drawn out of or pushed into the heating chamber, it is extremely difficult to ensure the durability of the power line.

In order to solve the problems mentioned above, an engagement-disengagement mechanism must be adopted in which the driving unit requiring power supply such as the rotary motor is left in the main body and the turntable having food loaded thereon is moved together with the drawer body, wherein the driving unit and the turntable are engaged and disengaged by the movement of the drawer body.

One idea of such engagement-disengagement mechanism is a magnet coupling capable of transmitting power in a noncontact manner.

The present applicant has proposed (refer to patent document 3: Japanese patent application laid-open publication No. 2004-071213) a cooking device adopting a uniform heating mechanism for rotating a turntable via the drive force of a rotary motor disposed outside a casing by utilizing the magnetic coupling of a first magnet in the turntable and a second magnet in the drive mechanism in a general microwave oven. When the rotation mechanism proposed here is assembled in a drawer type cooking device, even without considering the cost of the magnet, there is a drawback in that a problem occurs in the operation of the drawer type cooking device.

That is, since the magnet coupling is linked magnetically in the perpendicular direction corresponding to the direction of the rotary shaft, the drive mechanism portion and the rotary operation portion are strongly attracted to each other in the perpendicular direction when the drawer body is to be opened, and a large load is applied to the movement mechanism moving in the direction orthogonal to the rotary shaft for moving the drawer body in the horizontal direction, according to which the drive force must be increased and smooth draw-out operation cannot be performed. Thus, from the viewpoint of cost and reliability, the magnet coupling could not be applied to drawer type microwave ovens.

Further, an engagement-disengagement mechanism for moving the turntable in the perpendicular direction is also considered as another example of the engagement-disengagement mechanism.

Such engagement-disengagement mechanism requires an anticollision means for the upward movement of the turntable when moving the receiver in the frontward direction. As a result, a limitation must be set to the height of the food and the like, and the ceiling height of the heating chamber is thus substantially lowered. Therefore, it is difficult to adopt an engagement-disengagement mechanism that moves the turntable in the perpendicular direction.

The present applicant has proposed in patent document 2 (Japanese utility model registration No. 2520881) a cooking device having a round turntable with a rotating body disposed near the circumference of the bottom surface of the turntable, a driven shaft fixed to the center portion of the bottom surface of the turntable passing through the receiver and having a driven gear fixed to the lower end thereof, the turntable rotatably mounted on the receiver, wherein the driven gear is engaged with a drive gear fixed to an end of the rotary shaft of the turntable driving motor when the door is closed, and the driven gear is disengaged from the drive gear when the door is opened and the receiver is moved in the frontward direction.

According to the cooking device, the drive gear and the driven gear are bevel gears that are widened toward opposite directions, and the gears are required be engaged when the door is closed in order to operate. In order for the gears to accurately encounter each other and to be accurately engaged with one another each time the door is repeatedly opened and closed, not only a very high component accuracy and assembly accuracy unprecedented in the prior art cooking device is required, but also the abrasion and deformation of the respective components caused by repeatedly opening and closing the door must be reduced significantly so as to maintain constant dimension and constant engagement. It is difficult to adopt such engagement-disengagement mechanism.

Even if one of the above-mentioned mechanisms is adopted, since the movement mechanism must be mounted on the outer side of the bottom portion of the heating chamber in order to support the weight of the door and the drawer body having food loaded therein according to the prior art drawer type microwave oven, the drive mechanism of the turntable cannot be extended downward from the heating chamber, and since microwaves are distributed also in the space between the drawer body and the heating chamber, it was difficult to dispose the motor composed of metallic components therein, so the installation of the drive mechanism became a problem.

As described, since adopting a turntable having an engagement-disengagement mechanism in the cooking device was a common challenge for those in the field of art, many studies have been performed related to various design options.

Further, U.S. Pat. No. 5,796,802 proposes a microwave oven having a division plate with multiple turn trays disposed within a heating chamber. This microwave oven has division plates mounting turn trays inserted horizontally in the heating chamber of the microwave oven, and the turn trays are attached removably to the division plate. A mechanism for rotating the turn trays adopts a rim (outer circumference) drive structure, having a gear disposed on a rotary shaft extending in the perpendicular direction of the drive motor disposed at the depth portion of the heating chamber, and the tray disposed on the division plate has a rotary teeth portion revolving at the lower rim portion of the tray, wherein the motor applies drive force to the rotary teeth portion to rotate the turn tray. If the division plate is attached to the depth portion of the heating chamber, the gear and the rotary teeth are mutually engaged, and the turn tray can be rotated via the motor. If the division plate is moved to the frontward direction, the gear and the rotary teeth are disengaged, so the turn tray will not be rotated. The rotary teeth portion has a relatively large radius so that a gentle cylindrical curved surface is formed, and it is tolerant to the positional dispersion with respect to the gear in the horizontal direction. Further, the gear and the rotary tooth portion can be engaged via friction transmission engagement instead of gear engagement.

However, as obvious to the engineers in this trade, turn trays for cooking devices of reasonable prices are almost without exception designed and manufactured for attaining lowest cost, not for high precisions. It is therefore deduced, according to this microwave oven, that the rotary teeth portion at a radial distance of approximately 15 cm from the center of rotation has a dimensional dispersion of a few mm from the center of rotation. Thus, when the turn tray is rotated, the rotary teeth portion and the gear repeatedly collide against one another generating noise and vibration, so it may be necessary to take measures to prevent separation for example by pressing the turn tray toward the depth direction via an elastic body. Moreover, if the turn tray is reduced in size due to the individual dimensional fluctuation of the turn tray, which often overwhelms manufacturer's control, there always are risks that the rotary teeth portion may not be engaged with the gear. However, the attempt to improve the dimensional precision of the turn tray in order to overcome this problem will result in the increase of cost.

Further, in order for the turn tray to be engaged to the gear in a disengageable manner, an opening must be formed to the engaged portion between the gear at the depth wall surface of the heating chamber and the rotary teeth portion. Thus, boiled over water or the like may flow downward through the opening. Drawer type cooking devices must have a space between the depth of the drawer body and the depth wall of the heating chamber for disposing the gear. Such arrangement is considered to create a drawback in that the depth of the drawer body is narrowed, by which the storage space for loading the object to be heated is also narrowed.

When drinks are to be heated in a drawer type microwave oven, drink containers are loaded in the drawer body drawn out of the heating chamber, but the heights thereof differ, and high narrow containers are intentionally formed by some designers. In order to store such high containers in the heating chamber, the height of the heating chamber must be increased, and if the microwave oven adopts a ceiling surface power supply structure, the ceiling height of the whole microwave oven body must necessarily be increased.

According to the prior art drawer type microwave ovens, power supply structures including the waveguide and uniform heating mechanisms such as a rotary antenna mechanism are disposed on the ceiling, and the ceiling must provide space for arranging such mechanisms. However, since the built-in space in which such drawer type microwave ovens are installed has a strict height limitation within the fitted kitchen or designed kitchen structure, it is actually impossible to increase the exterior height of the drawer type microwave ovens. Since the overall height of the microwave ovens was restricted, it was difficult to respond to the size-related demand of the object to be heated.

A cooking method using a thermal shock system in which high-temperature air heated via a heater is collided at high speed against an object to be cooked through an air blower is known. The present applicant proposes (refer to patent document 4: Publication of Japanese patent No. 3939232) a cooking device comprising a heating chamber for storing an object to be cooked, a heating means for heating the object to be cooked within the heating chamber, an air blower means for introducing hot air of the heating means into the heating chamber, and a control means for controlling the heating means and the air blower means, wherein the hot air via the heating means is blown into the heating chamber via multiple air blow paths and air supply outlets, and a control means controls the heating means and/or the air blower means and performs cooking via multiple circulating hot air systems by selecting and combining multiple air blow paths, thereby enabling a single cooking device to perform multiple cooking operations via selecting and combining the multiple air blow paths. Therefore, a single cooking device enables to perform multiple cooking methods, such as a cooking method preferable for high speed heating for cooking pizza or a lump of meat such as roast chicken, in which the heat transfer of the surface of the object to be cooked is improved by the wind pressure of the thermal shock, and a normal speed cooking method preferable for cooking an object to foam the same, such as baking a sponge cake, or for cooking an object containing much air.

It is difficult to introduce the hot air cooking function to the prior art drawer type microwave oven to obtain a composite cooking device. One reason for this is that the prior art drawer type microwave oven adopts a ceiling surface power supply structure, so that the uniform heating mechanism adopting a waveguide and a rotary antenna must be arranged on the outer space on the ceiling of the heating chamber, and attaching heat insulating materials required for hot air cooking is difficult. Another reason is that a high-speed hot air heating cooker suitably assembled as a high speed heating function to the microwave oven requires a uniform heating mechanism such as a turntable in which the object to be heated is moved within the heating chamber, so that it cannot easily be assembled to the prior art drawer type microwave oven adopting a rotary antenna instead of a turntable.

Moreover, the cooker with a high speed hot air cooking device proposed in patent document 4 (publication of Japanese patent No. 3939232) assumes a consumption power exceeding 2000 W since the specification thereof realizes a high speed cooking operation corresponding to or exceeding the cooking operation using a gas oven, and has a large-capacity heating chamber. Therefore, in order to adopt the high-speed hot air cooking function in a drawer type cooking device built into a kitchen and assuming a consumption power of approximately 1200 W, it is necessary to reduce the consumption power and improve the heat radiation performance.

SUMMARY OF THE INVENTION

The problem to be solved in the drawer type cooking device having a drawer body capable of being drawn out of a heating chamber is to provide a uniform heating mechanism via a turntable to the drawer body and to perform smooth transmission and disconnection of power between the turntable and a motor disposed outside the heating chamber corresponding to the drawing out and storing of the drawer body with respect to the heating chamber.

The object of the present invention is to provide a drawer type cooking device capable of rotating the turntable on the drawer so as to heat the object to be cooked in a uniform manner and prevent uneven heating caused by the position and the posture of the object within the heating chamber, and to prevent the increase of height of the device by discarding the prior art rotary antenna and the confirmation means for electronically or optically detecting the rotation status of the rotary antenna.

Another problem to be solved in the drawer type cooking device is to arrange a power feeding structure and a uniform heating mechanism using the outer space on the sides and bottom areas of the heating chamber instead of the ceiling surface power supply structure and the uniform heating mechanism disposed on the ceiling.

The object of the present invention is to solve the problems mentioned above by eliminating the ceiling power supply structure using the waveguide and the uniform heating mechanism such as the rotary antenna mechanism disposed on the ceiling, thereby providing a drawer type cooking device capable of increasing the ceiling height of the heating chamber as much as possible without increasing the overall height of the cooking device.

The present invention provides a drawer type cooking device having a drawer body capable of being stored into or drawn out of a cooking device body having a heating chamber formed in an interior thereof, wherein a door of the drawer body closes a front side opening of the heating chamber when the drawer body is at a stored position; the cooking device comprising: a turntable supported rotatably on a bottom wall of the drawer body; a motor disposed outside the heating chamber at a bottom wall portion of the cooking device body; and a power transmission mechanism disposed between the bottom wall portion of the cooking device body and the bottom wall of the drawer body, being engaged when the drawer body is pressed into the cooking device body and disengaged when the drawer body is drawn out of the cooking device body, capable of transmitting a rotation of the motor to the turntable when engaged; the power transmission mechanism comprising: a first transmission unit attached to an output shaft of the motor passing through the bottom wall portion of the cooking device body and protruding into the heating chamber; a second transmission unit attached to a rotation shaft of the turntable passing through the bottom wall of the drawer body and protruding into the heating chamber; and a sector-type transmission unit disposed pivotally on the cooking device body, constituting a first engagement portion on an outer radial side being engaged with the power transmission unit and also constituting a second engagement portion on an inner radial direction opening toward a draw-out direction of the drawer body and engaging with the second transmission unit when the drawer body is at a stored state.

According to the drawer type cooking device of the present invention described above, it is possible to rotate the turntable on the drawer body capable of being drawn out of the cooking device body so as to heat the object to be cooked in a uniform manner and eliminate uneven heating caused by the position of the object within the heating chamber. The prior art rotary antenna is no longer necessary, and thus, the confirmation means such as an electronic or optical rotation detecting means for confirming the rotation status of the rotary antenna visually and detecting the stopping of the rotary antenna in order to prevent the occurrence of uneven heating is no longer necessary. Furthermore, since the rotary antenna is unnecessary, the height of the cooking device will not be increased.

In order to achieve the above-mentioned objects, the present invention further provides a drawer type cooking device having a drawer body capable of being drawn out of or stored in a cooking device body having a heating chamber formed in an interior thereof, wherein a door of the drawer body closes a front side opening of the heating chamber when the drawer body is at a stored position; the cooking device comprising a turntable and a driving mechanism thereof disposed with respect to a bottom wall of the drawer body, and a side wall power supply structure disposed within a side wall space on the outer side portion of the heating chamber.

According to the present drawer type cooking device, a side wall power supply structure is adopted as the power supply structure for supplying microwaves into the heating chamber, and arranges the turntable and the drive mechanism thereof with respect to the bottom wall of the drawer body as a uniform heating mechanism, so that the ceiling does not have the power supply structure and the uniform heating mechanism arranged thereto. The waveguide for guiding the microwaves generated via the high frequency generating device for generating microwaves is arranged on the side wall space on the outer side portion of the heating chamber and constituting the side wall power supply structure, and the microwaves transmitted through the waveguide are irradiated through the side wall of the heating chamber into the heating chamber. Uneven heating of the object to be heated that may occur at this time may be prevented by rotating the turntable within the heating chamber.

According to the above-mentioned drawer type cooking device, a slide mechanism for moving the drawer body with respect to the cooking device body can be disposed at a lower portion of the side wall space of the heating chamber.

According to the drawer type cooking device of the present invention arranged as above, the following effects are achieved. At first, the turntable disposed on the drawer body enables food to be heated uniformly. Further, since the arrangement adopts a side wall power supply structure in which the waveguide is disposed on the side wall space at the outer side portion of the heating chamber, there is no need to arrange the waveguide on the ceiling, and the ceiling height of the heating chamber can be increased while suppressing the increase of height of the cooking device body.

Moreover, since a movement mechanism for moving the drawer body with respect to the cooking device body is arranged at the lower portion of the side wall space of the heating chamber, a space for arranging the side wall power supply structure is secured in the side wall space, and when the drawer body is drawn out, the movement mechanism is positioned at the lower side of the drawer body so as not to interfere with the operation to take the object in and out of the drawer body, according to which the taking in and out of the object is facilitated. Further, by arranging the operation panel on the upper portion of the door, the thickness of the ceiling can be reduced compared to the case where the operation panel is arranged on the front side of the ceiling, and therefore, the height of the heating chamber can be increased.

The conventionally prevailing drawer type microwave oven is a "single function" type device in which the cooking operation is restricted to the microwave heating operation. On the other hand, a drawer type electrothermal or photothermal cooking device or a drawer type warmer device having a heat-retaining function did not have a microwave heating function. It seems that there has not been any proposal of a drawer type cooking device with a composite function having both the microwave heating function and a different heating function.

However, there are demands from users for a drawer type cooking device having both the microwave heating function and another heating function. The expected use of the additional heating function of such drawer type cooking device is supplemental, such as during a party or the like where a large number of people are to be treated, and the individually disposed electrothermal cooking device is already being used, electrothermal cooking of another food can be performed in parallel using the drawer type cooking device.

The single-function microwave oven has superior energy-saving performance since the cooking operation is completed in a short time compared to hot-air cooking devices and radiant heat cooking devices, but the microwave oven has a short operation time as a cooking device. This is one of the reasons why users feel that single-function microwave ovens have a low level of contribution in the overall heating operation performed in the kitchen. Based on such recognition of the level of contribution of the microwave ovens, consumers desire multiple functions to be adopted in microwave ovens, and responding to such demands has been a challenge for the prior art microwave ovens.

According to the prior-art microwave ovens placed on a counter top, such desires of consumers, especially the desire of consumers to perform baking operation in microwave ovens, has caused the development of microwave ovens having a composite heating function, and consumers are now similarly expecting the drawer type cooking device to have multiple functions.

The object of the present invention is to provide a multi-function drawer type cooking device having a composite cooking function for performing a cooking function corresponding to a wide range of menus by adopting a high-speed hot air heating function to the drawer type microwave oven, which had not been possible according to the prior art drawer type microwave oven.

In order to solve the problems of the prior art, the present invention further provides a drawer type cooking device comprising a cooking device body including a heating chamber, a drawer body having a door for opening and closing an opening of the heating chamber and movably disposed within the cooking device body so as to be drawn out of the interior of the heating chamber of the cooking device body, and a movement mechanism disposed outside the heating chamber and supporting the door on the heating chamber outside the heating chamber so as to move the drawer body within the cooking device body, wherein the drawer type cooking device has both a microwave heating function and a high-speed hot air heating function as the heating functions for heating an object within the heating chamber.

According to this aspect of the invention, the drawer type cooking device has a high-speed hot air heating function in addition to the microwave heating function, so that a variety of cooking methods can be realized via a single cooking device.

The present invention further provides a drawer type cooking device as described above, wherein a turntable for loading the object to be heated is disposed on a bottom portion of the drawer body; the microwave heating function is a function for irradiating microwaves from a side wall of the heating chamber to the object to be heated placed on the turntable; and the high-speed hot air heating function is a function for blowing out hot air at high speed from a ceiling of the heating chamber toward the object to be heated loaded on the turntable, and for blowing out hot air having lower speed compared to the hot air from the ceiling toward the object to be heated loaded on the table.

According to the high-speed hot air heating function, hot air is blown at high speed from the ceiling of the heating chamber toward the upper surface of the object to be heated placed on the turntable, according to which the upper surface of the object to be heated is mainly heated at high speed, but the side surfaces and the lower surface of the object to be heated are not sufficiently heated since the speed of hot air supplied from the ceiling is slowed down and the air passes these areas without performing thermal shock heating. Therefore, patent document 4 (publication of Japanese patent No. 3939232) adopts an arrangement in which hot air supplied through the side wall is blown toward the side surfaces and the lower surface of the object to be heated to compensate for the lack of heating, thereby aiming to achieve uniform heating. As described, a uniform heating mechanism adopting a turntable is necessary to uniformize the partial auxiliary heating using the hot air supplied through the side wall.

The uniform heating mechanism adopting the turntable is also effective for the microwave heating function.

According to the above-mentioned drawer type cooking device, a heat insulating material can be disposed on left and right side walls of the heating chamber and a ceiling of the heating chamber. By disposing heat insulating material on the left and right side walls and the ceiling of the heating chamber, it is possible to ensure the heat insulating effect with respect to the hot air flowing through the outside space of the side wall and the ceiling.

According to the above-mentioned drawer type cooking device, a waveguide for guiding the microwaves generated via a microwave generating device into the heating chamber is disposed on an outside space of the side wall of the heating chamber; and an upper duct for guiding the flow of the hot air heated via a heater is disposed on an outside space of the ceiling of the heating chamber. By disposing the waveguide for guiding the microwaves and the upper duct for guiding the flow of the hot air along the outside space of the side wall or the ceiling of the heating chamber, it becomes possible to prevent the increase of size of the whole body of the drawer type cooking device.

According to the above-mentioned drawer type cooking device, a fan unit composed of a fan and a fan casing storing the fan can be disposed on an outside space on a depth wall of the heating chamber, wherein an upper duct extending to the outside space of the ceiling of the heating chamber and a side wall duct extending to the outside space of the side wall of the heating chamber are connected to the fan casing of the fan unit. By disposing the fan unit on an outside space on a depth wall of the heating chamber and connecting the upper duct and the side wall duct to the fan casing, it becomes possible to send the hot air from the fan unit disposed on the outside space on the depth wall of the heating chamber through the upper duct and/or the side wall duct into the heating chamber, so that the system for supplying hot air into the heating chamber can be simplified.

According to the above-mentioned drawer type cooking device, the upper duct is a duct having a thin rectangular cross-section extending from an upper side air outlet of the fan casing and disposed in a bent manner along the depth wall and the ceiling toward the front side of the heating chamber, and the hot air flowing through the upper duct is blown out through an upper air supply outlet formed centrally around a center area of the ceiling of the heating chamber downward toward the turntable. In other words, since the upper duct is formed as a duct having a thin rectangular cross-section extending from the upper side air outlet of the fan casing in a bent manner along the depth wall and the ceiling, the upper duct having a thin rectangular cross-section arranged along the heating chamber takes up little space. Further, the hot air supplied through the upper duct is discharged through the upper side air outlet formed centrally around the center area of the ceiling of the heating chamber downward toward the object to be heated loaded on the turntable, according to which the object can be cooked via a thermal shock method.

According to the above-mentioned drawer type cooking device, the side wall duct is a duct having a thin rectangular cross-section extending from a side air outlet of the fan casing and disposed in a bent manner along the depth wall and one of the side walls of the heating chamber toward the front side of the heating chamber, and the hot air flowing through the side wall duct can be blown out through a side wall air supply outlet formed centrally around a center area of the one of the side walls of the heating chamber laterally toward an upper area of the turntable. In other words, since the side wall duct is formed as a duct having a thin rectangular cross-section extending from the side air outlet of the fan casing in a bent manner along the depth wall and one of the side walls of the heating chamber, the side wall duct having a thin rectangular cross-section arranged along the heating chamber takes up little space. Further, the hot air supplied through the side wall duct is discharged through the side wall air supply outlet formed centrally around the center area of the side wall of the heating chamber laterally toward the object to be heated loaded on the turntable, according to which the side surfaces of the object to be heated can be cooked via a thermal shock method.

According to the drawer type cooking device of the present invention, an opening connected to an air intake duct of the fan can be disposed at a depth portion of the other side wall of the heating chamber. The hot air blown into the heating chamber heats the object to be heated, and returns from the opening formed at the depth portion of the other side wall of the heating chamber via the intake duct to the fan. The fan can further send out the hot air returned via the intake duct, reheat the same and blow the same via the upper duct and/or the side wall duct into the heating chamber.

The prior art drawer type microwave ovens have disposed on the rear wall portion of the main body of the microwave oven electric components composed of a power supply unit and the like including a magnetron, a high pressure transformer for supplying power to the magnetron, and a high pressure capacitor, and an air blower for blowing air to the electric components for cooling the same, and sending a portion of the air having cooled the electric components into the heating chamber. According to the drawer type cooking device of the present invention, a fan unit composed of a fan and a fan casing storing the fan is disposed on an outside space on a depth wall of the heating chamber, so that the electric components and the air blower are disposed on the side wall, especially on the side wall different from the side wall having the side wall duct disposed thereon.

According to the above-mentioned drawer type cooking device, the drawer body can be supported via the door by the cooking device body outside the heating chamber, and the movement mechanism can be supported on the bottom wall of the heating chamber. Since the drawer body is supported via the movement mechanism by the bottom wall of the heating chamber, it is no longer necessary to use the space on the outer side of the side wall of the heating chamber for disposing the movement mechanism, and this outer side wall space can be used for disposing the side wall duct.

The prior art drawer type microwave ovens have disposed on the rear wall portion of the main body of the microwave oven electric components composed of a power supply unit and the like including a magnetron, a high pressure transformer for supplying power to the magnetron, and a high pressure capacitor, and an air blower for sending a portion of the air having cooled the electric components into the heating chamber. According to the drawer type cooking device of the present invention, a fan unit composed of a fan and a fan casing storing the fan is disposed on an outside space on a depth wall of the heating chamber, so that the electric components and the air blower are disposed on the side wall capable of ensuring space, especially on the side wall different from the side wall having the side wall duct disposed thereon.

The above-mentioned drawer type cooking device according to the present invention has a high-speed hot air heating function in addition to a microwave oven function for microwave heating in a drawer type cooking device, so that a drawer type cooking device capable of performing composite heating operations combining both cooking methods can be provided.

BRIEF DESCRIPTION OF THE DRAWINGS

FIG. 17 is a perspective view showing one example of a cabinet structure to which the cooking device is built in.

DETAILED DESCRIPTION OF THE PREFERRED EMBODIMENTS

Figure 1:
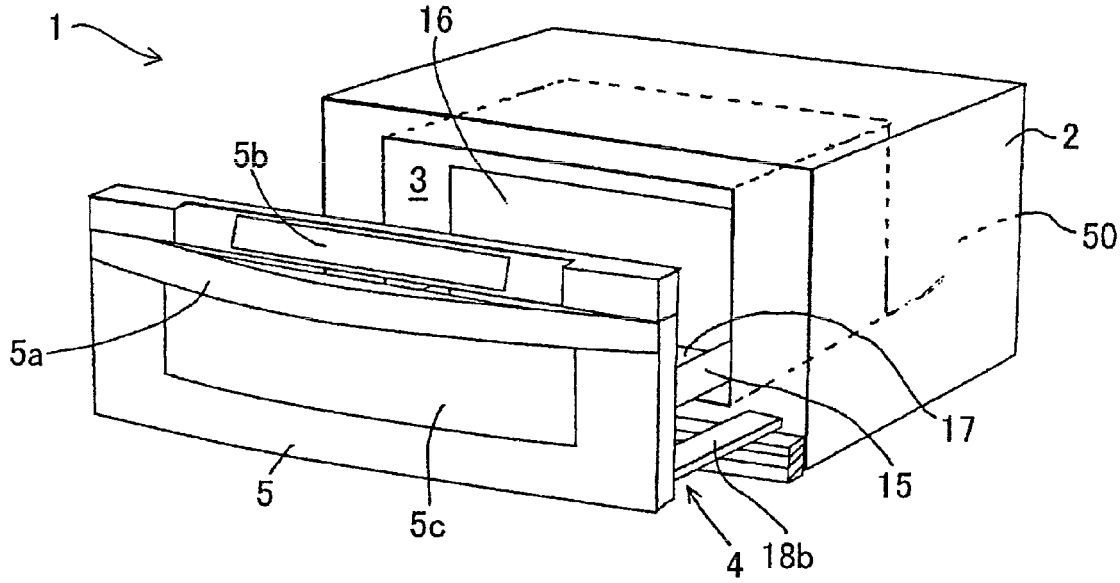
FIG. 1 is an external perspective view showing a drawer type microwave oven as the drawer type cooking device according to the present invention, wherein the drawer body is drawn out.
Figure 2:
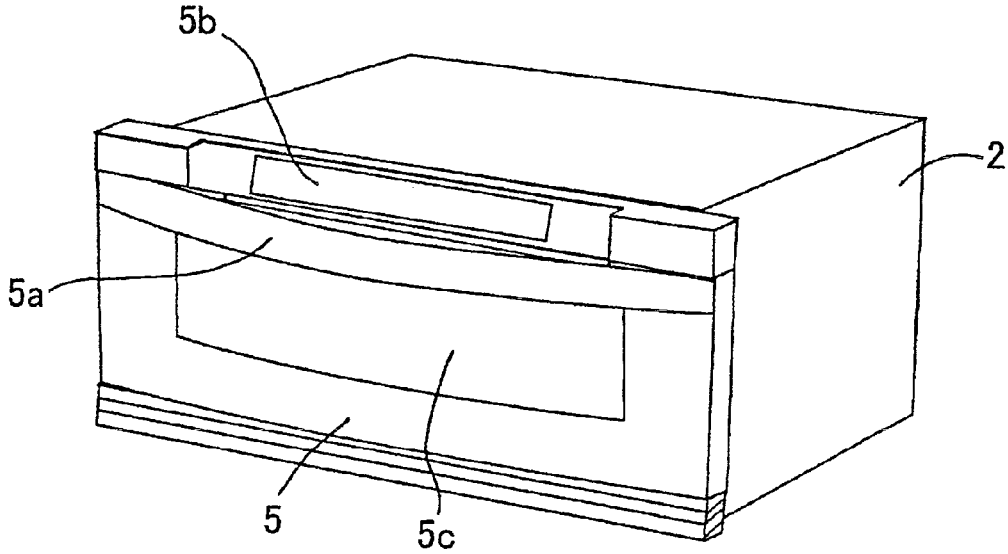
FIG. 2 is a perspective view showing the drawer type heating cooker, wherein the drawer body is at a stored state.

Now, the preferred embodiments of a drawer type cooking device according to the present invention will be described with reference to the drawings. FIG. 1 is an external perspective view showing the drawer type cooking device according to the present invention as a drawer type microwave oven, wherein the drawer body is shown in the drawn out state. FIG. 2 is a perspective view of the drawer type cooking device according to claim 1, wherein the drawer body is stored.

As illustrated in FIGS. 1 and 2, the drawer type cooking device 1 comprises a cooking device body 2 having in the interior thereof a heating chamber 3 into which microwaves are irradiated, and a drawer body 4 capable of being drawn out to the exterior of the cooking device body 2 (the drawn out state being illustrated in FIG. 1) from a stored state within the heating chamber 3 (the state shown in FIG. 2). The drawer body 4 has a door 5 disposed at a front end portion thereof, wherein the door shuts an opening portion 6 of the heating chamber 3 when the drawer body 4 is stored in the cooking device body 2.

An operation panel 5*b* is disposed together with a handle 5*a* at an upper portion of the door 5 disposed on the front side of the drawer body 4. Since the operation panel 5*b* is disposed at the upper portion of the door 5, there is no need to dispose the operation panel on a front side of a ceiling portion 11 of the cooking device body 2 as according to the prior art, the thickness of the ceiling portion 11 can be suppressed to realize a thinner structure, and the height of the cooking device body 2 can therefore by suppressed. Further, a window 5*c* allowing users to look into the heating chamber 3 while preventing microwave transmission is formed on the front side of the door 5. A slide mechanism 18 capable of allowing the drawer body 4 to be drawn out of or stored into the cooking device body 2 is disposed between the lower side portion of the door 5 constituting the structure of the drawer body 4 and a lower portion of the side wall space of the cooking device body 2.

FIG. 1 shows a state where the movable rail 18*b* constituting the slide mechanism 18 is attached to a lower side portion of the door 5. The slide mechanism 18 is disposed on the outer side of the heating chamber 3 so as not to be influenced by microwaves or food residue and the like of the heating cooker, and the mechanism can comprise a movable rail 18*b* attached to both side portions of the door 5 and a fixed rail 18*a* attached to the cooking device body 2 and slidably attached to the movable rail. In the present embodiment, the movable rail 18*b* is a transversely disposed long rail, which is slidably supported with respect to the fixed rail 18*a* in the cooking device body 2 (refer to FIGS. 3 and 4). The fixed rail 18*a* is driven to be drawn out of or stored into the cooking device body 2 via the output of a motor as drive source disposed within the cooking device body 2. By this movement of the movable rail 18*b*, the drawer body 4 can be drawn out of or stored into the heating chamber 3 of the cooking device body 2 via the door 5. The slide mechanism 18 equipped with a drive mechanism such as a motor and a transmission mechanism for transmitting the output thereof enables to automatically open and close the drawer body 4.

By adopting the above-described arrangement, according to the drawer type cooking device disclosed in patent document 1 (Japanese patent application laid-open publication No. 2005-221081: Publication of Japanese patent No. 4027325) the fixed rail 18*a* is disposed substantially at the center of height of the outer side wall of the heating chamber, but the fixed rail is moved along an extended line of a lower portion of the outer side wall of the heating chamber, so that the space having been occupied by the fixed rail 18*a* and the movable rail 18*b* according to the prior art can be used to arrange a side wall power supply mechanism.

In FIG. 1, the drawer body 4 is composed of both side walls 15 and 15 having a low height, a rear wall 16 and a bottom wall 17, but only small portions thereof are illustrated. The front end portions of the side walls 15 and 15 and the bottom wall 17 are attached to the door 5. The upper area of the drawer body 4 is opened, and when the drawer body 4 is drawn out of the cooking device body 2, an object to be cooked such as a tray T and food F placed thereon to be heated can be put into or taken out of the drawer body 4. Since the height of the side wall 15 is sufficiently low compared to the height of the heating chamber 3, the object to be cooked such as food can also be easily put into or taken out of the drawer body 4 from the sides.

Figure 3:
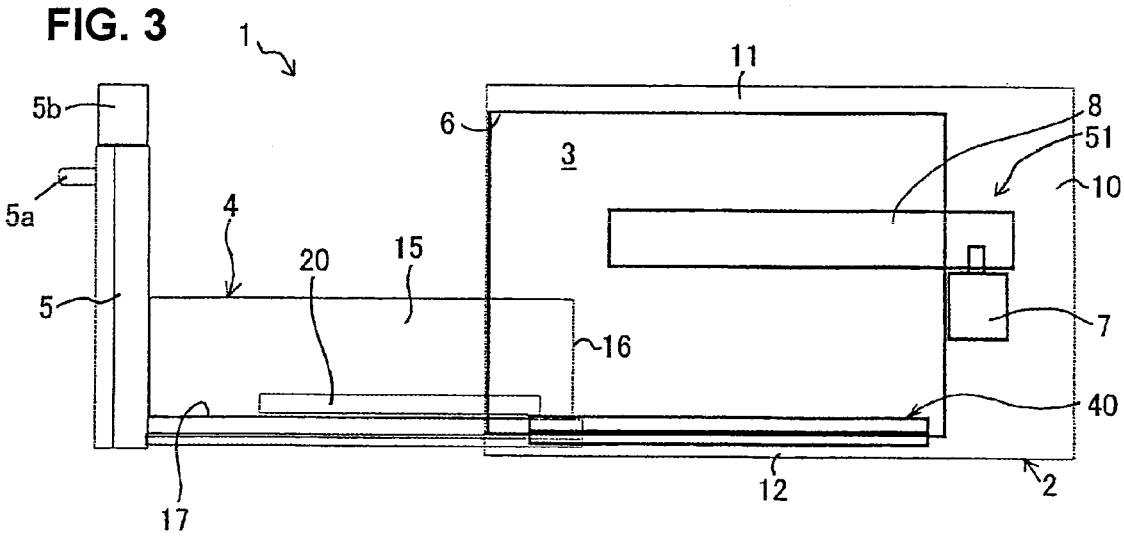
FIG. 3 is a schematic side view of the drawer type cooking device according to the present invention, wherein the drawer body is at a drawn out state.
Figure 4:
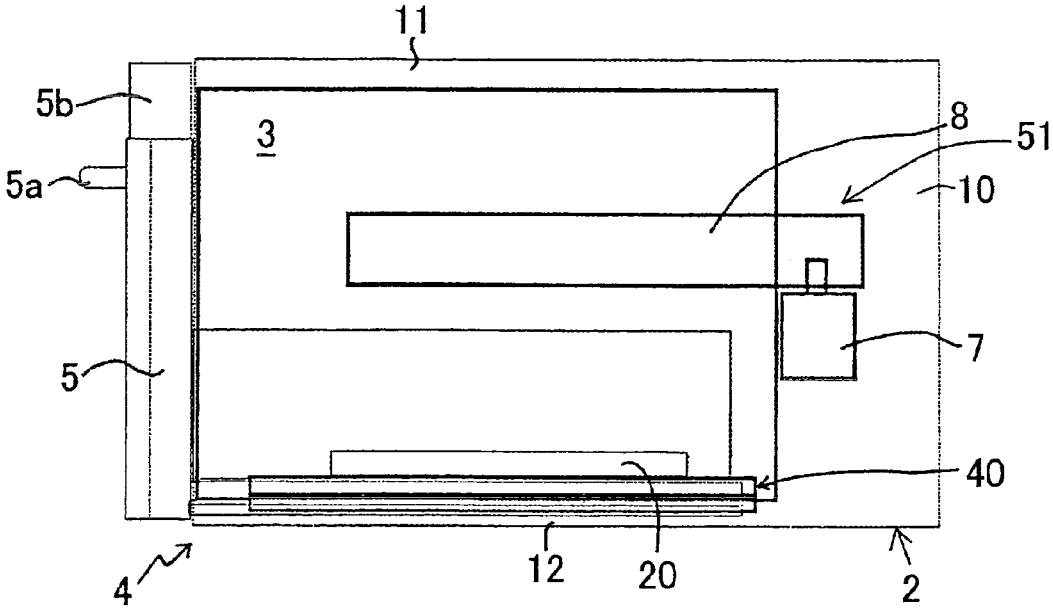
FIG. 4 is a schematic side view of the drawer type cooking device shown in FIG. 3, wherein the drawer body is stored inside the cooking device body.

FIGS. 3 and 4 are schematic side views of the drawer type cooking device according to the present invention, wherein FIG. 3 is a view showing the state where the drawer body is drawn out, and FIG. 4 is a view showing the state where the drawer body is stored in the cooking device body. The elements also illustrated in FIGS. 1 and 2 are provided with the same reference numbers, and the descriptions thereof are omitted. FIGS. 3 and 4 show side views for better understanding of the relative arrangements of elements viewed from the side for describing the side wall power supply structure.

On the rear wall portion 10 of the cooking device body 2 are disposed a magnetron 7 for generating microwaves, a high pressure transformer 9 (not shown in FIGS. 3 and 4) for supplying power to the magnetron 7, electric components such as a power supply unit including a high pressure capacitor, and an air blower for blowing air toward the electric components for cooling the same and for sending a portion of the air having cooled the electric components into the heating chamber 3.

A side wall power supply structure 51 composed of a waveguide 8 for conducting the microwaves having been generated by the magnetron 7 from the rear wall portion 10 into the heating chamber 3 is disposed on a side wall space 50 (FIG. 1) formed within the cooking device body 2 on the outer side portion of the heating chamber 3. The magnetron 7 is stored in the rear wall portion 10, but an antenna for outputting the generated microwaves is inserted through an opening formed on a depth portion of the waveguide 8 into the waveguide 8, so that the microwaves generated by the magnetron 7 can be propagated in the waveguide. The microwaves thus introduced through the waveguide 8 are irradiated through the side wall 13 of the heating chamber 3 (refer to FIG. 5) into the heating chamber 3.

In FIGS. 3 and 4, a turntable 20 is rotatably disposed on a bottom wall 17 of the drawer body 4, and a drive mechanism 40 (which will be described in detail later) for rotating the turntable 20 is disposed in a space 19 formed between an upper surface of the bottom wall portion 12 of the cooking device body 2 and the bottom wall 17 of the drawer body 4 at the stored state. A fixed rail 18*a* of the slide mechanism 18 is fixed to the cooking device body 2 at the lower portion of the side wall space 50, which supports a movable rail 18*b* attached to the door 5 in a slidable manner. The weight of the drawer body 4 and the object to be cooked can be supported by the heating chamber 3 via a roller or other means (not shown) at the rear portion, and can be supported by the cooking device body 2 via the movable rail 18*b* through the door 5 at the front portion. Further, a wire arrangement (not shown) for supplying power, sending and receiving signals and the like for the operation panel 5*b* is arranged along the fixed rail 18*a* and the movable rail 18*b*.

Figure 5:
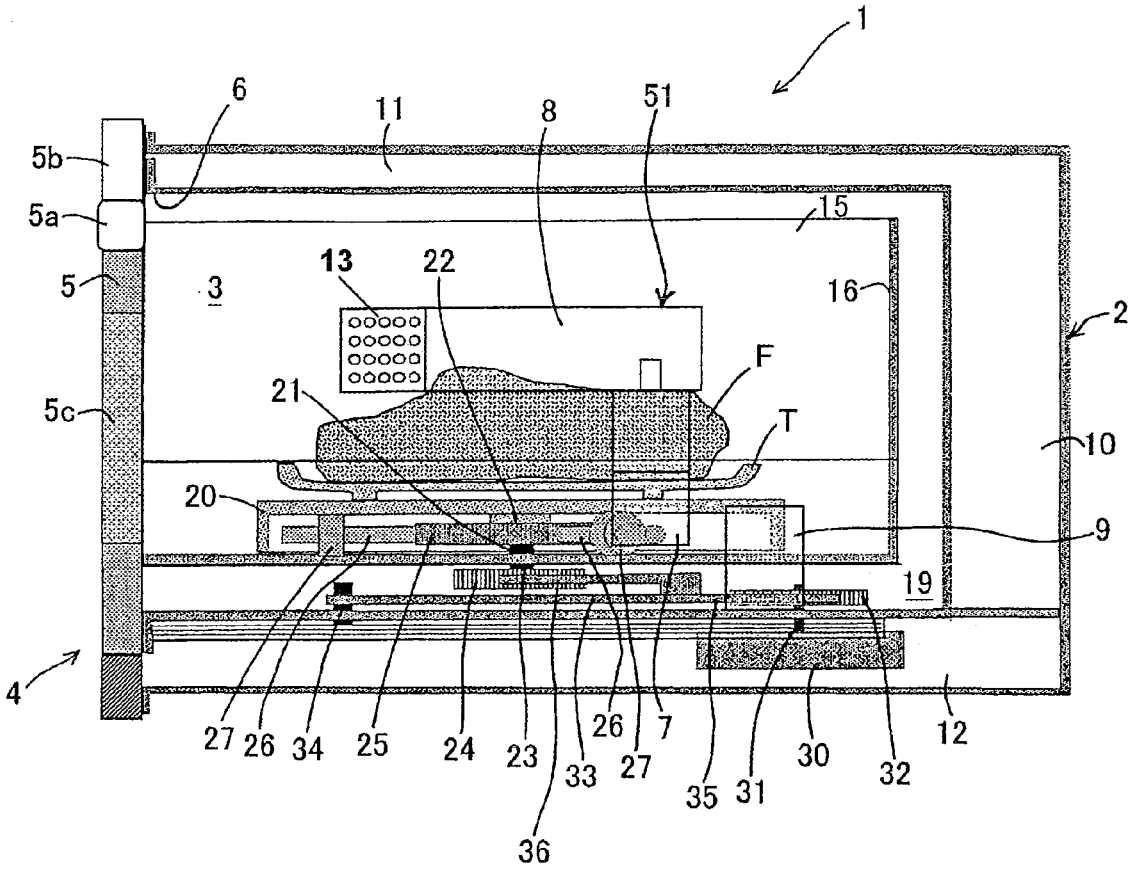
FIG. 5 is a cross-sectional side view of the drawer type cooking device according to the present invention.
Figure 6A:
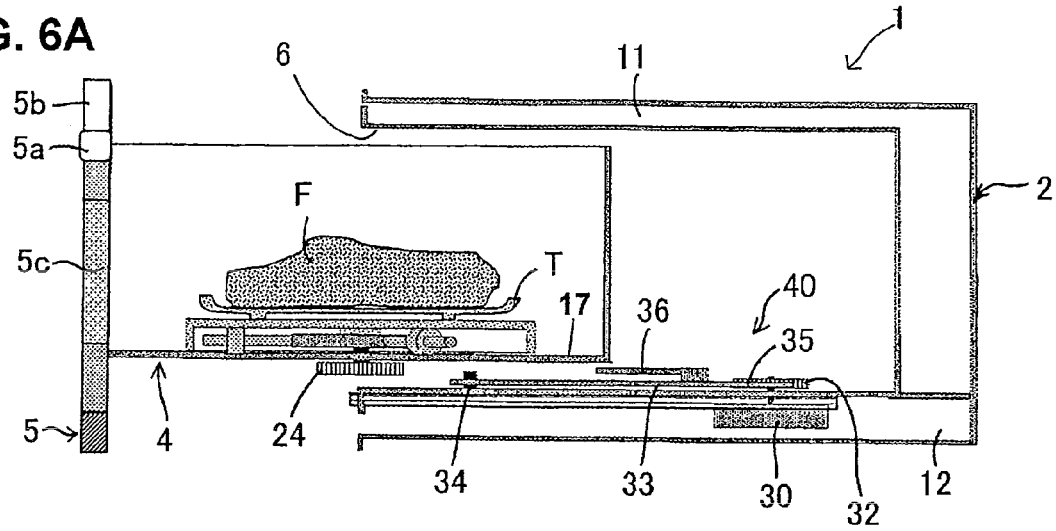
FIG. 6A is a cross-sectional side view of the drawer type cooking device shown in FIG. 5, wherein the drawer body is drawn out.
Figure 6B:
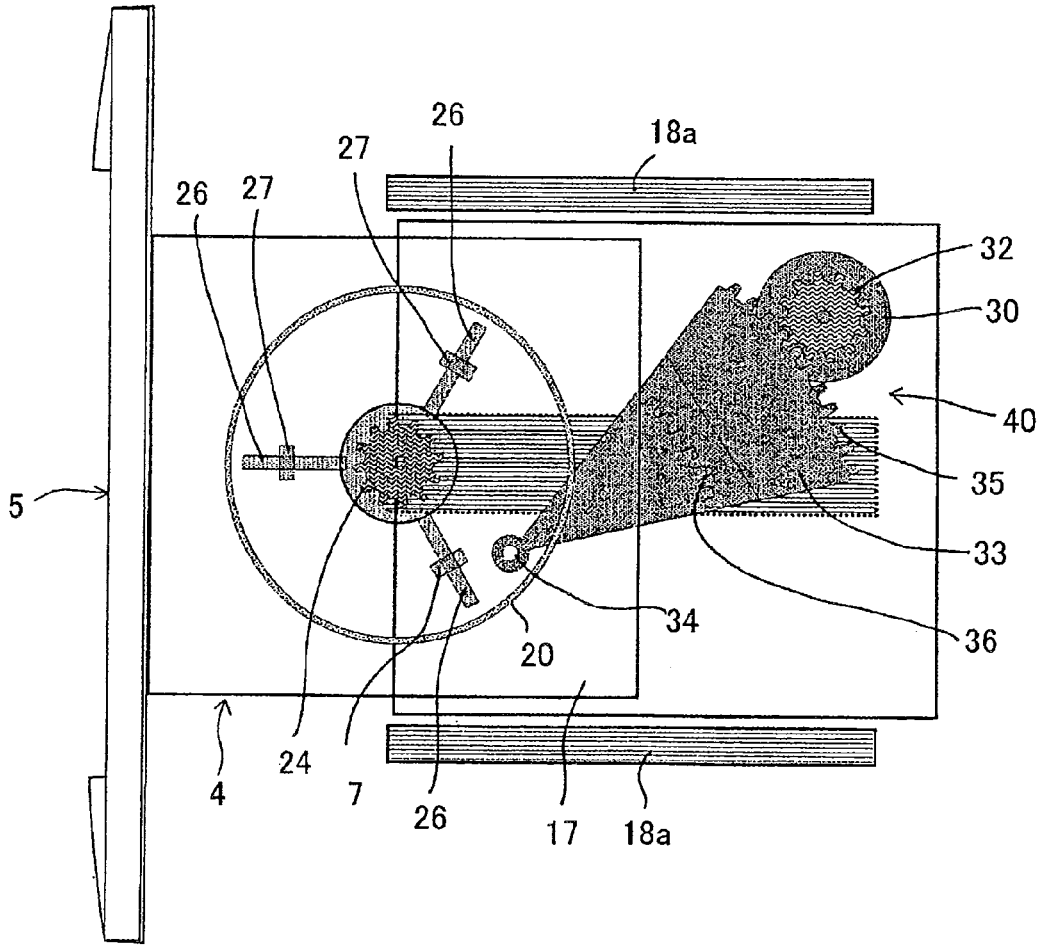
FIG. 6B is a cross-sectional planar view of the drawer type cooking device shown in FIG. 5, wherein the drawer body is drawn out.
Figure 7A:
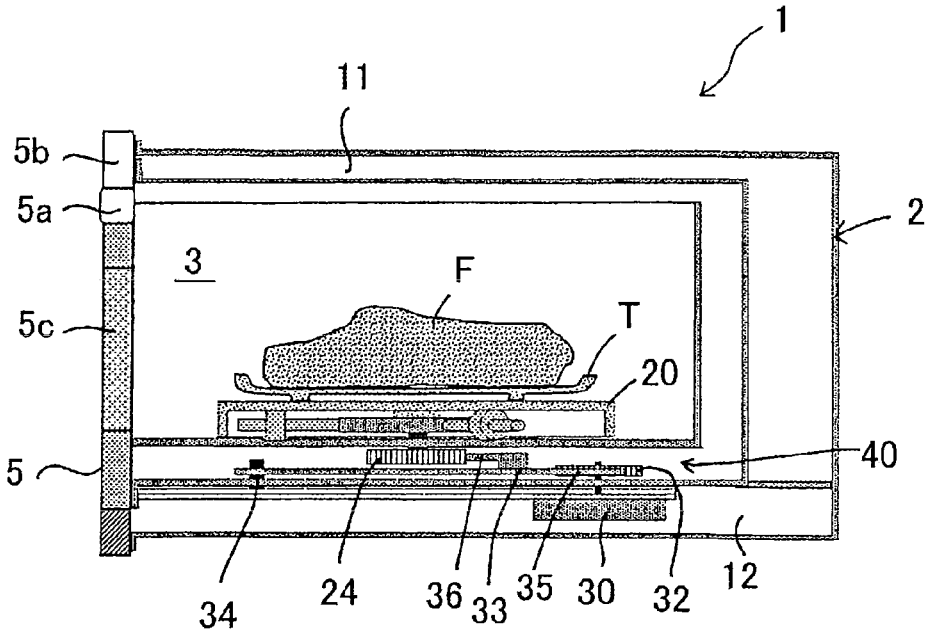
FIG. 7A is a cross-sectional side view of the drawer type cooking device shown in FIG. 5, wherein the drawer body is stored.
Figure 7B:
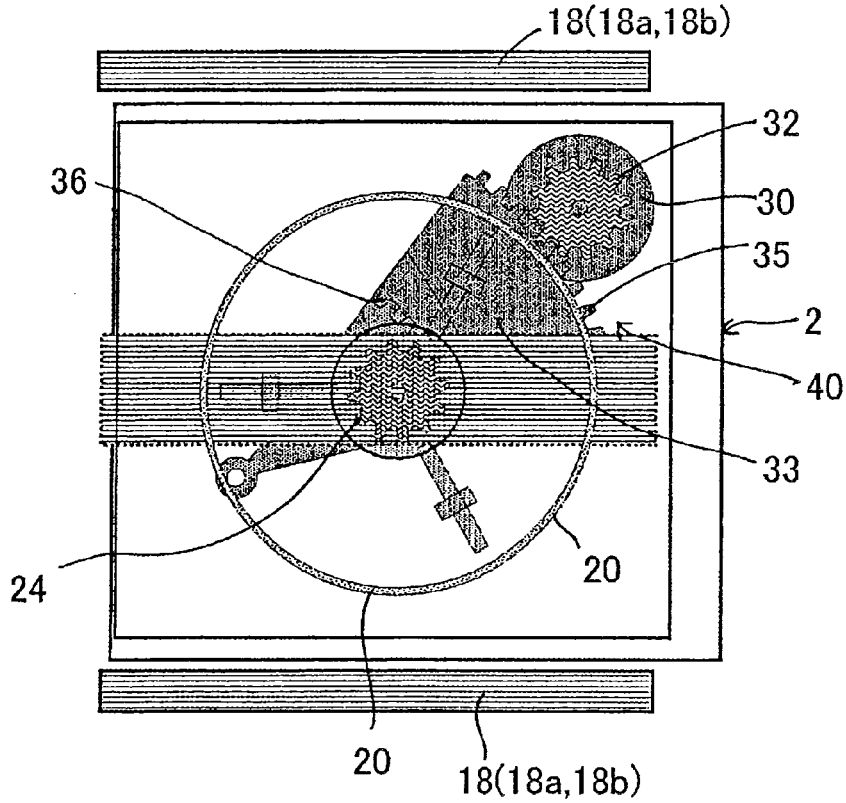
FIG. 7B is a cross-sectional planar view of the drawer type cooking device shown in FIG. 5, wherein the drawer body is stored.
Figure 8:
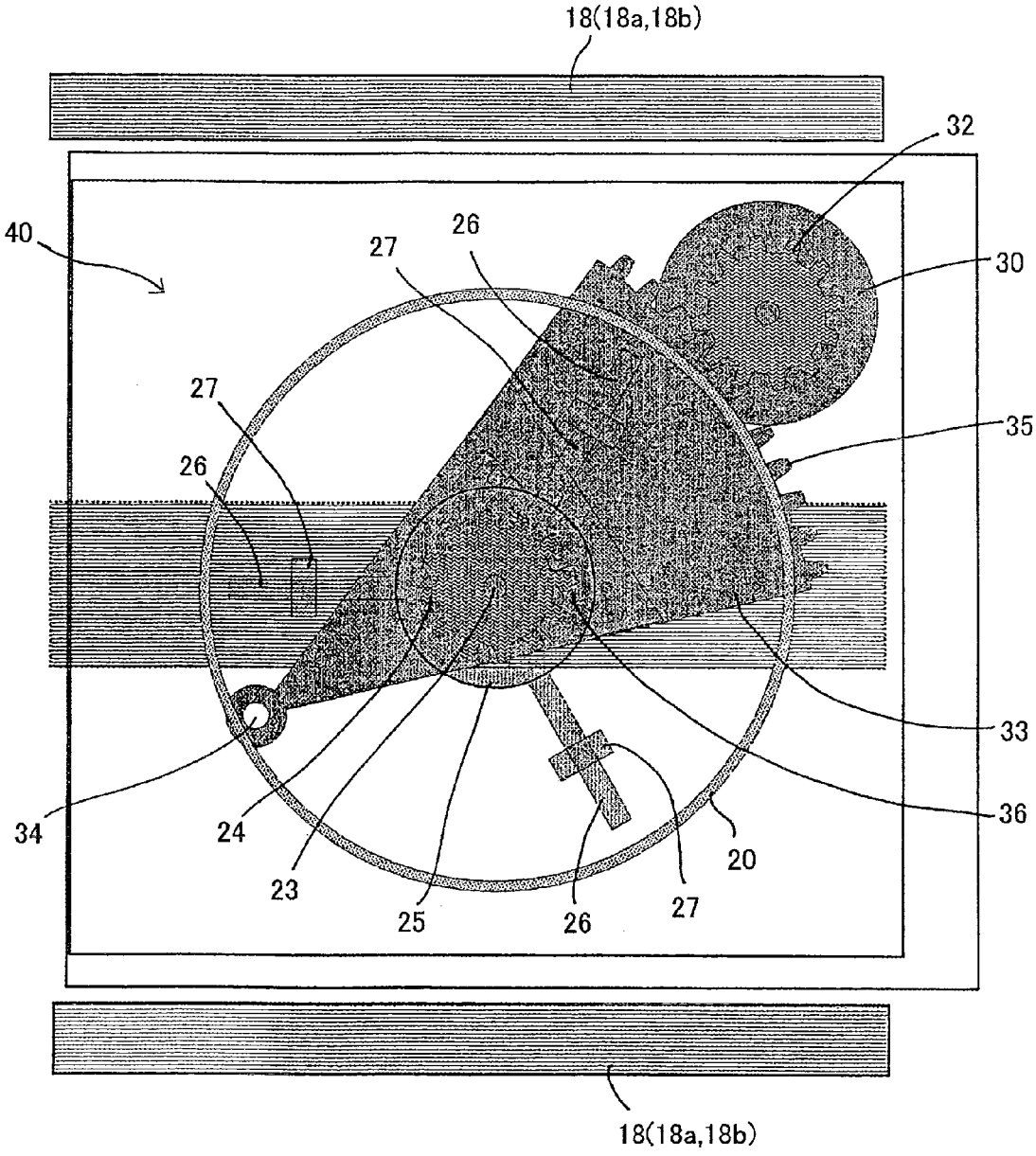
FIG. 8 is a bottom view of the drawer type cooking device shown in FIG. 5 including a turntable drive mechanism.

Now, we will describe the turntable driving mechanism adopted in the drawer type cooking device of the present invention. FIG. 5 is a cross-sectional side view of the drawer type cooking device, FIG. 6A is a cross-sectional side view showing the drawer type cooking device illustrated in FIG. 5 with the drawer body drawn out, FIG. 6B is a cross-sectional planar view showing the drawer type cooking device illustrated in FIG. 5 with the drawer body drawn out, FIG. 7A is a cross-sectional side view showing the drawer type cooking device illustrated in FIG. 5 with the drawer body stored, FIG. 7B is a cross-sectional planar view showing the drawer type cooking device illustrated in FIG. 5 with the drawer body stored, and FIG. 8 is a bottom view of the drawer type cooking device including a turntable drive mechanism.

The cooking device body 2 has a magnetron 7 for generating microwaves disposed at the rear wall portion 10 thereof, and a waveguide 8 disposed on a ceiling portion 11 for introducing the microwaves generated by the magnetron 7 into the heating chamber 3. Further, an air blower for sending air to the power supply system or the heating chamber 3 is disposed on the rear wall portion 10 of the cooking device body 2. Moreover, the drive mechanism 40 of the turntable according to the present invention is disposed on the bottom wall portion 12 of the cooking device body 2.

A space 19 for arranging the turntable drive mechanism 40 according to the present invention described later is formed between the upper surface of the bottom wall portion 12 of the cooking device body 2 and the bottom wall 17 of the drawer body 4.

In order for the drawer body 4 to be able to be drawn out with respect to the cooking device body 2, a slide mechanism (not shown) is disposed between the cooking device body 2 and the drawer body 4.

A turntable 20 capable of rotating arbitrarily around a center axis 21 is mounted at the upper center portion of the bottom wall 17 of the drawer body 4. An object to be cooked (a tray T and food F to be heated) is placed on the rotation table 20. A rotary shaft 21 fixed to the turntable 20 at an upper end portion 22 is disposed on the lower side of the turntable 20, and the rotary shaft 21 is extended below the drawer body 4 through the bottom wall 17 of the drawer body 4. At the lower area of the bottom wall 17, a drive gear 24 as turntable transmission unit is attached to the lower end 23 of the rotary shaft 21 for rotating and driving the turntable 20 (which will be described in detail later). Further, a disk 25 is fixed to the rotary shaft 21 at the center area thereof, and support shafts 26, 26 and 26 extending at angular intervals (in the example, in three directions at 120-degree intervals) are attached to the disk 25. Each shaft 26 has a roller 27 rotatably disposed thereto, wherein the roller 27 contacts the turntable 20 at the upper side thereof and contacts the bottom wall 17 at the lower side thereof, and rolls on the bottom wall while supporting the weight of the turntable 20 and the object to be cooked.

A motor 30 as an external drive source for driving the turntable 20 is arranged at one corner within the bottom wall portion 12 of the cooking device body 2. The output shaft 31 of the motor 30 is extended upward through the bottom panel of the bottom wall portion 12 via an electric wave leak structure and protrudes into the heating chamber 3. Thus, the motor 30 is placed outside the heating chamber 3, so that it is not exposed to microwaves irradiated into the heating chamber 3. An output gear 32 as rotation motor transmission unit is attached to the upper end of the output shaft 31. Further, a sector gear 33 having a substantially fan shape is pivotally supported on a pivot axis 34 on the upper side of the bottom wall portion 12. The rotation shaft 21 of the turntable 20 occupies the center position between the pivot axis 34 of the sector gear 33 and the output shaft 31 of the motor 30 when the drawer body 4 is at the stored state.

The sector gear 33 has on the outer circumference side of the fan-shaped body a circular arc-shaped externally toothed gear portion 35 constantly engaged with the output gear 32 and forming a first engagement portion, and has on the inner circumference side of the fan-shaped body having a concentric shape with the outer circumference of the fan shape a circular arc-shaped internally-toothed gear portion 36 engaged with the drive gear 24 and forming a second engagement portion. In order to enable the internally-toothed gear portion 36 to be removed and attached along the horizontal direction, the portion 36 is somewhat lifted up in an offset manner in the axial direction from the fan-shaped body of the sector gear 33. The pivot axis 34 is placed at a position close to the opening 56 of the heating chamber 3 so as not to interfere with the drive gear 24 passing by when the drawer body 4 is moved in and out. The output gear 32, the sector gear 33 and the drive gear 24 constitute a power transmission mechanism 40 for transmitting the output rotation of the motor 20 to the turntable 20.

The internally-toothed gear portion 36 forming the second engagement portion has a pitch radius having a radius of curvature sufficiently greater than the drive gear 24 of the rotary portion, which is opened toward the direction of movement of the drawer body 4. When the drawer body 4 is stored in the cooking device body 2, the drive gear 24 is simply moved in the horizontal direction so as to engage with the internal tooth of the internally-toothed gear portion 36 via a moderate accuracy, and when the drawer body 4 is opened, the drive gear 24 simply moves in the horizontal direction and is disengaged smoothly from the internally-toothed gear portion 36.

As described, the turntable 20 is rotatably disposed on the bottom wall 17 of the drawer body 4, and the rotary shaft 21 of the turntable 20 is protruded downward through the bottom wall 17 of the drawer body 4. A driving motor 30 is disposed on the outer side of the bottom wall portion 12 of the heating chamber 3, and the output shaft 31 of the motor 30 is protruded upward through the bottom wall portion 12 of the heating chamber 3 via the electric wave leak structure. The lower end 23 of the rotary shaft 21 of the turntable 20 and the output shaft 31 of the motor 20 are horizontally spaced apart and disposed in the space 19 formed between the bottom wall 17 of the drawer body 4 of the drawer type cooking device 1 and the upper surface of the bottom wall portion 12 of the heating chamber 3, and the drive gear 24 and the output gear 32 are respectively disposed in a horizontally offset manner.

Figure 9:
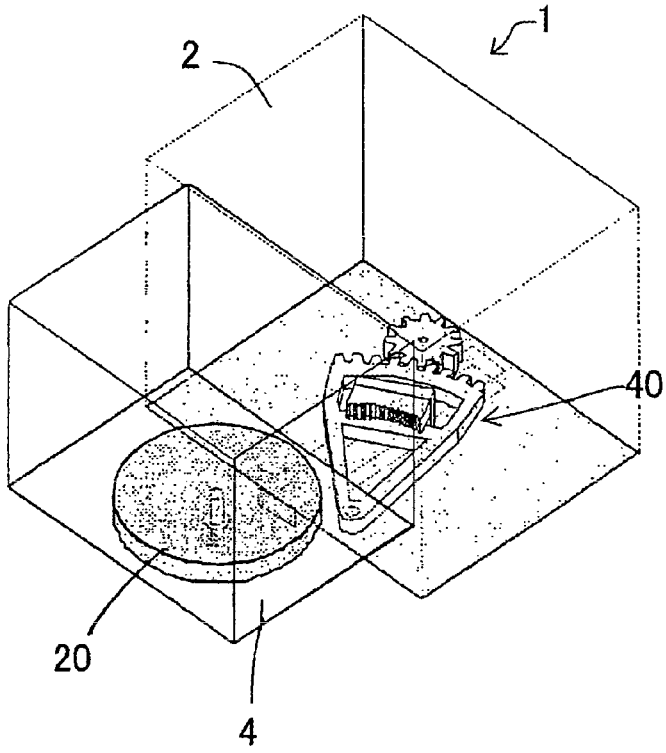
FIG. 9 is a perspective view of the drawer type cooking device shown in FIG. 5, wherein the drawer body is drawn out of the cooking device body.
Figure 10:
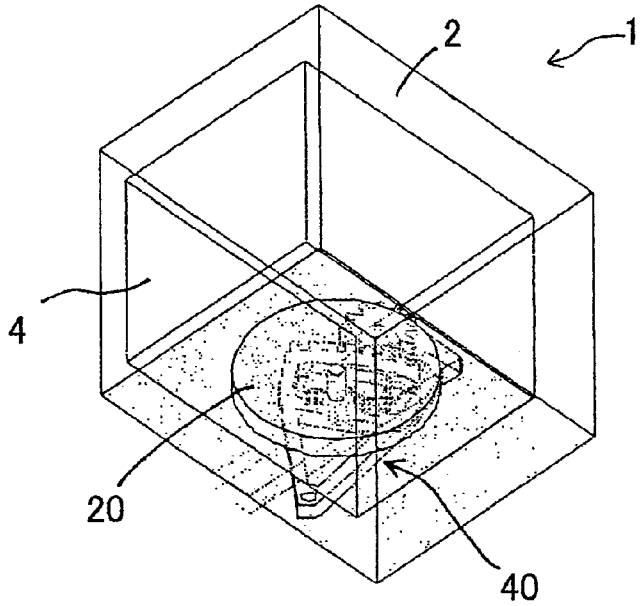
FIG. 10 is a perspective view of the drawer type cooking device shown in FIG. 6, wherein the drawer body is pushed into the cooking device body.

FIG. 9 is a perspective view showing the state where the drawer body 4 is drawn out of the cooking device body 2, and FIG. 10 is a perspective view showing the state where the drawer body 4 is pressed into the cooking device body 2. When the drawer body 4 is pushed into the cooking device body 2, the drive gear 24 appearing outward from the bottom wall 17 of the drawer body 4 is moved in the space 19 above the bottom wall portion 12. When the drawer body 4 is completely pushed into the cooking device body 2, the drive gear 24 is engaged with the internally-toothed gear portion 36 of the sector gear 33.

Figure 11:
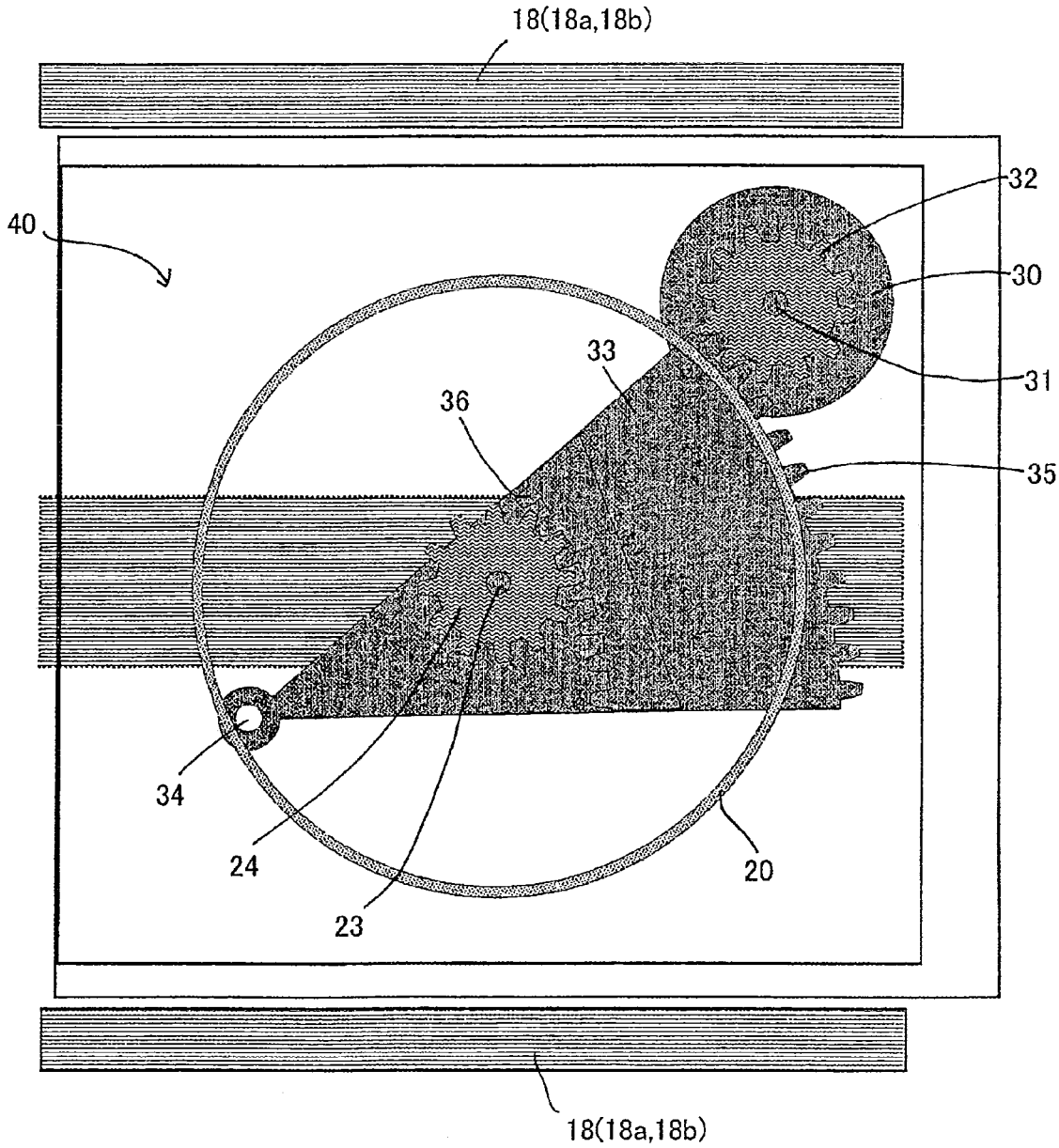
FIG. 11 is a bottom view of the drawer type cooking device shown in FIG. 8, showing a state where a drive gear of the cooking device is engaged with an internally-toothed circular arc gear of a sector gear and then rotated.
Figure 12:
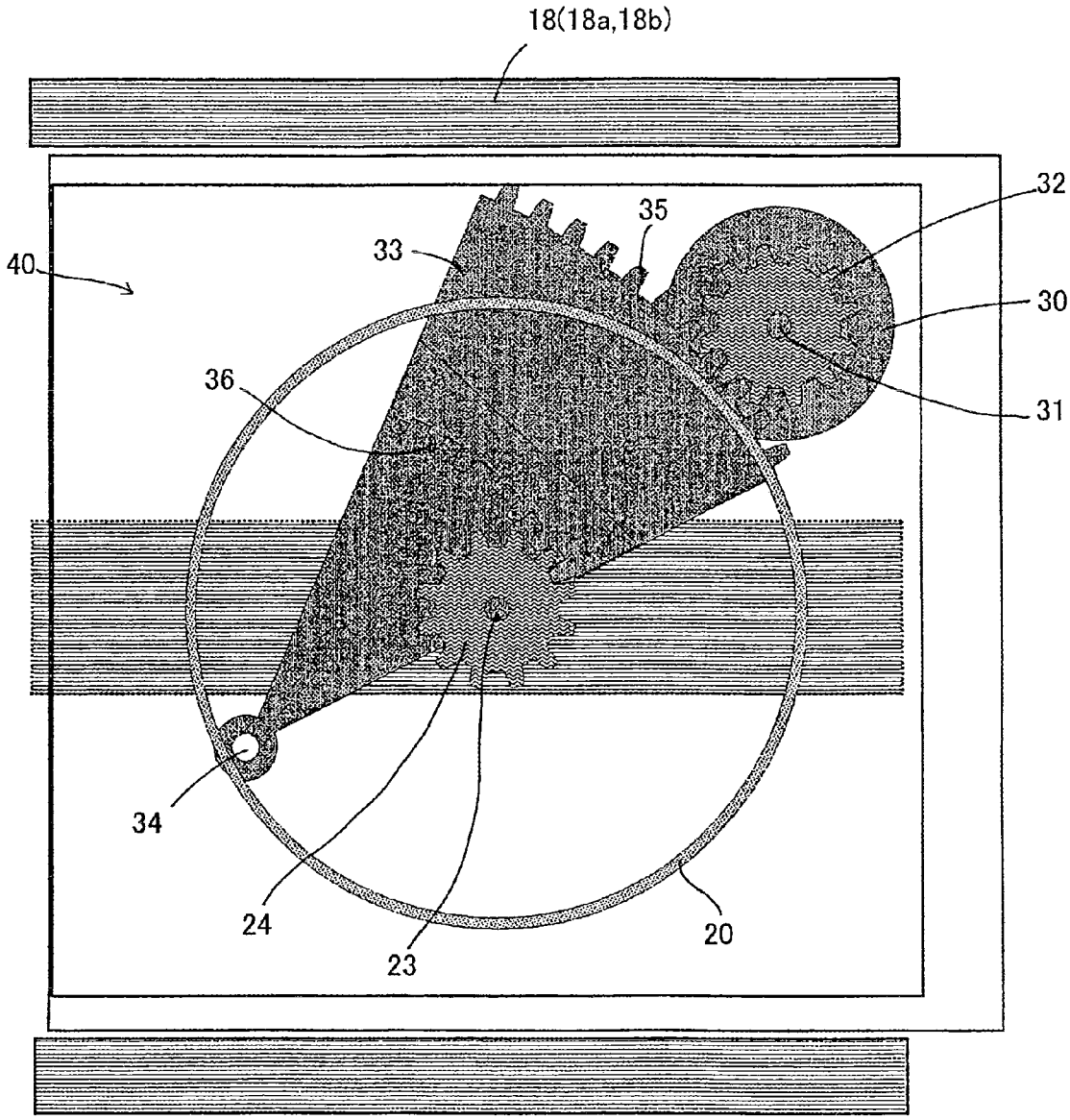
FIG. 12 is a bottom view showing another rotation state of the drawer type cooking device illustrated in FIG. 11.

FIGS. 11 and 12 illustrate how the drive gear 24 being engaged with the internally-toothed gear portion 36 of the sector gear 33 is rotated. FIG. 11 shows a state where the sector gear 33 is swung to the farthest position in the counterclockwise direction. FIG. 12 shows a state where the sector gear is swung to the farthest position in the counterclockwise direction. When the motor 30 is driven and the output shaft 31 together with the output gear 32 attached thereto rotates, the sector gear 33 pivots about the pivot axis 34, and the drive gear 24 engaged with the internally-toothed gear portion 36 is driven to rotate. By automatically reversing the direction of rotation of the motor 30 in response to the position of the sector gear 33, the sector gear 33 is inverted and pivots repeatedly within the pivoting range. The pivoting range of the sector gear 33 corresponds to a single rotation of the drive gear 24.

According to the arrangement of the present embodiment, since a turntable 20 is disposed in the drawer body 4, the floor surface of the drawer body 4 is raised and the ceiling height of the heating chamber 3 is relatively lowered, but since the uniform heating mechanism including the turntable 20 is provided, the rotation antenna having been mounted on the ceiling surface can be eliminated and the antenna-rotating motor mounted on the upper portion of the waveguide 8 can be eliminated. Thus, the lowering of ceiling height due to the height of the turntable 20 can be substantially compensated, enabling use of food or dishes having substantially the same height as those used in the prior art drawer type cooking device.

After the drawer body 4 is pressed and stored in the cooking device body 2 and preparation for cooking has been completed, the motor 30 is driven. By reversing the rotation of the motor 30 output per a predetermined number of rotations, the output gear 32 can pivot the sector gear 33 engaged therewith around the pivot axis 34 within a predetermined pivot angle. By reversing the rotation of the rotary shaft 21 of the drive gear 24, the rotation of the turntable 20 is inverted repeatedly at predetermined angles. The turntable 20 does not rotate continuously but pivots back and forth within a fixed rotation angle, but since the loaded object to be cooked passes substantially all the distribution area of microwaves distributed in a non-uniform manner, the dispersion of microwaves is equalized, and uniform heating substantially equal to the continuously rotated turntable is enabled.

As described, since uniform heating is enabled by the pivot-rotation of the turntable, the power transmission between the output gear 32 of the motor 30 positioned at one corner of the drawer body and the drive gear 24 positioned near the center area of the drawer body can be performed via the sector gear 33 instead of a circular gear, and the sector gear 33 moves in pivoting motion around the pivot axis 34 disposed at the corner opposite to the motor 30 of the drawer body.

Furthermore, the engagement between the drive gear 24 and the sector gear 33 is performed by the engagement of the circular arc-shaped internally-toothed gear portion 36 and the drive gear 24, but since the circular arc-shaped externally-toothed gear portion 35 has a radius substantially equal to the turntable and realizes a gear reduction ratio of the level substantially rotating the turntable for a single rotation by the pivoting movement of the sector gear 33 within the mechanically pivotable angular range of the sector gear, so that the drive gear 24 having a small outer shape is engaged with the arc-shaped internally-toothed gear portion 36 having a small curvature. Therefore, even if the position of the drive gear 24 is somewhat dispersed in the width direction of the cooking device body, gear engagement is facilitated during the engagement and disengagement operation.

If the motor 30 is designed so that its rotational output is continuous rotation but the mechanical arrangement thereof enables the rotation to be inverted within a fixed rotational angle, the motor having the required drive performance can be achieved inexpensively.

In order for the rotation of the output shaft 31 of the motor 30 to be inverted per a predetermined number of rotations, the motor 30 can utilize a servomotor in which a rotary encoder is disposed on the output shaft 31. The servomotor is capable of high level control, and is capable of obtaining a time series data of rotation angles. In an arrangement using the servomotor, it is possible to compute the rotational moment of the turntable 20 having food loaded thereon without performing feedback control by processing the rotational angle data when the motor is driven via a fixed rotational torque without performing feedback control. Since such rotational moment is strongly correlated with the mass of the food, the food mass can be estimated and used for setting up the heating time for performing automatic cooking. Automatic cooking is preferable, since in addition to the finish detection using a moisture sensor and the like, it is capable of preventing lack of heating or overheating of extremely large amounts or extremely small amounts of food.

When the drawer body 4 is stored, the rotation angle of the turntable 20 is uncertain, and if the engagement portion utilizes gears, it is possible that the engagement of the gears is incomplete. In that case, the engagement of the gears can be adjusted by slightly moving the power transmission mechanism 40 while applying horizontal movement force. Therefore, it is preferable that the power transmission mechanism 40 is controlled so that it is always slightly moved when the drawer body 4 is stored.

According to the above-mentioned power transmission mechanism 40, it is possible to replace the gears of the first and second engagement portions including the output gear 32, the sector gear 33 and the drive gear 24 with plastic toothed belts attached to the inner circumference sides of circular elastic bodies. The toothed belt arrangement is more preferable since less incomplete engagement occurs.

According to the above-mentioned power transmission mechanism 40, it is even more preferable to realize the first and second engagement portions via friction engagement of friction wheels with circular surfaces or circular-arc surfaces having a high friction coefficient instead of via the engagement of gears including the output gear 32, the sector gear 33 and the drive gear 24, since the problem of mismatch of gear engagement does not occur.

Further, except for the motor disposed outside the heating chamber 3, the power transmission mechanism 40 according to the present embodiment is disposed within the heating chamber 3 of the cooking device, above the drawer 4 or in the space 19 between the drawer body 4 and the heating chamber 3. Therefore, the power transmission mechanism 40 is exposed to electromagnetic induction via microwaves during cooking operation, but problems such as discharge or overheating will not occur to the structure if appropriate materials such as heat-resistant plastics, ceramics or heat-resistant glass having low dielectric loss are selected.

By adopting a uniform heating mechanism using a turntable 20 according to the present invention, the prior art rotation antenna disposed within a waveguide arranged on the ceiling becomes unnecessary. In the prior arrangement using the rotary antenna, the rotation state could not be visually confirmed, so the rotation state of the rotary antenna had to be confirmed via an electric or an optical rotation detecting means, but the present invention is preferable since such confirmation means becomes unnecessary. Further, since the rotation antenna becomes unnecessary, the antenna rotation motor disposed on the upper side of the ceiling waveguide no longer becomes necessary. Therefore, the ceiling surface of the heating chamber can be raised by approximately 20 mm. Thus, since the ceiling surface of the heating chamber 3 can be raised by approximately 60 mm in the end by taking measures such as moving the side wall power supply mechanism and the waveguide, moving the operation panel to the door, and arranging the side wall slide mechanism at a lower position, the ceiling height which was approximately 180 mm according to the prior art can be raised to 240 mm. Therefore, objects to be heated (such as food and drinks) can be heated in containers having a high height.

Since the pitch circle radius of the sector gear 33 of the power transmission mechanism 40 of the turntable 20 is large, the curvature of the pitch circle is small, and together with the fact that the sector gear 33 is socketed with respect to the horizontal moving direction of the drawer body 4, the positional relationship between the drawer body 4 and the heating chamber 3 is tolerant to the displacement in the width direction, and the engagement or disengagement of the gear of the turntable and the sector gear 33 is facilitated.

The above arrangement is preferable, since even when the user applies a lateral operation force to the drawer body when opening the door by holding the door handle and the drawer body is moved in a slanted direction, the misalignment of the engagement position of the gear of the turntable with respect to the recessed portion of the fan-shaped gear does not affect the effective engagement of the gears.

According to the present embodiment, the power transmission mechanism 40 is composed of independent components not related to the turning tray T or the turntable 20, not like the invention of U.S. Pat. No. 5,796,802 where a transmission unit such as a circumference toothed portion is disposed on the outer circumference of the turning tray, the present invention can lower the manufacturing cost while maintaining the dimensional accuracy of the sector gear 33 and the like. Since the only opening added to the drawer body 4 is the through portion of the rotary shaft 21 of the turntable 20 disposed at the center of the bottom wall 17 of the drawer body 4, and it is easy to realize a seal structure capable of preventing microwaves or water from passing such through portions at a low cost. Furthermore, since the power transmission mechanism 40 is stored below the bottom wall 17 of the drawer body 4 and the engagement portion of the output shaft 31 of the motor 30 and the sector gear 33 is disposed at the corner portion of the drawer body 4, it is no longer necessary to widen the space between the rear wall of the drawer body 4 and the rear wall of the heating chamber, so that a detachable tray T can be adopted as the drawer body 4 without reducing the depth of the drawer body 4.

Figure 13:
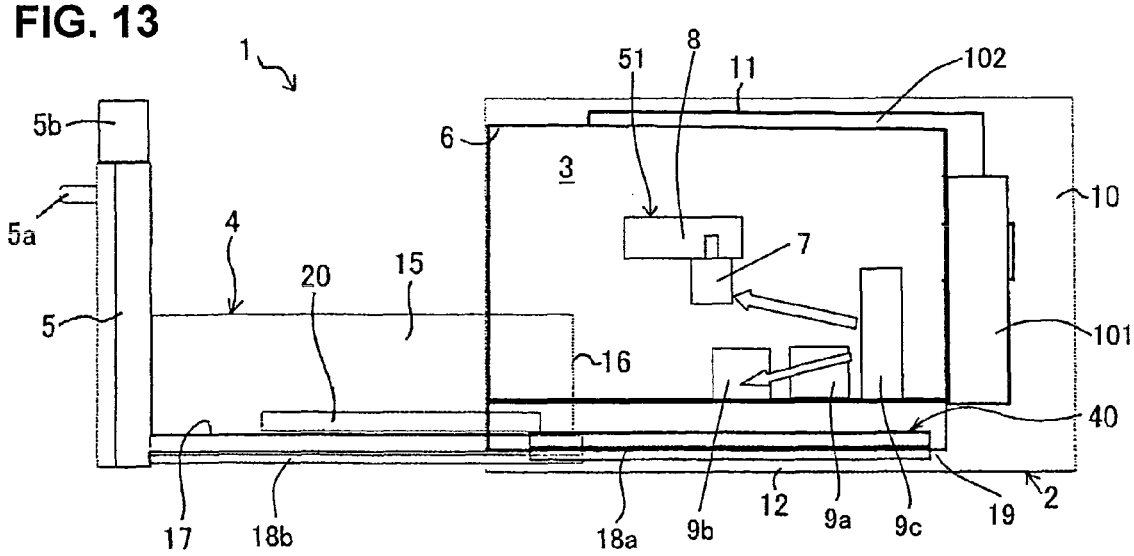
FIG. 13 is a schematic side view of the drawer type cooking device according to the present invention, wherein the drawer body is drawn out.
Figure 14:
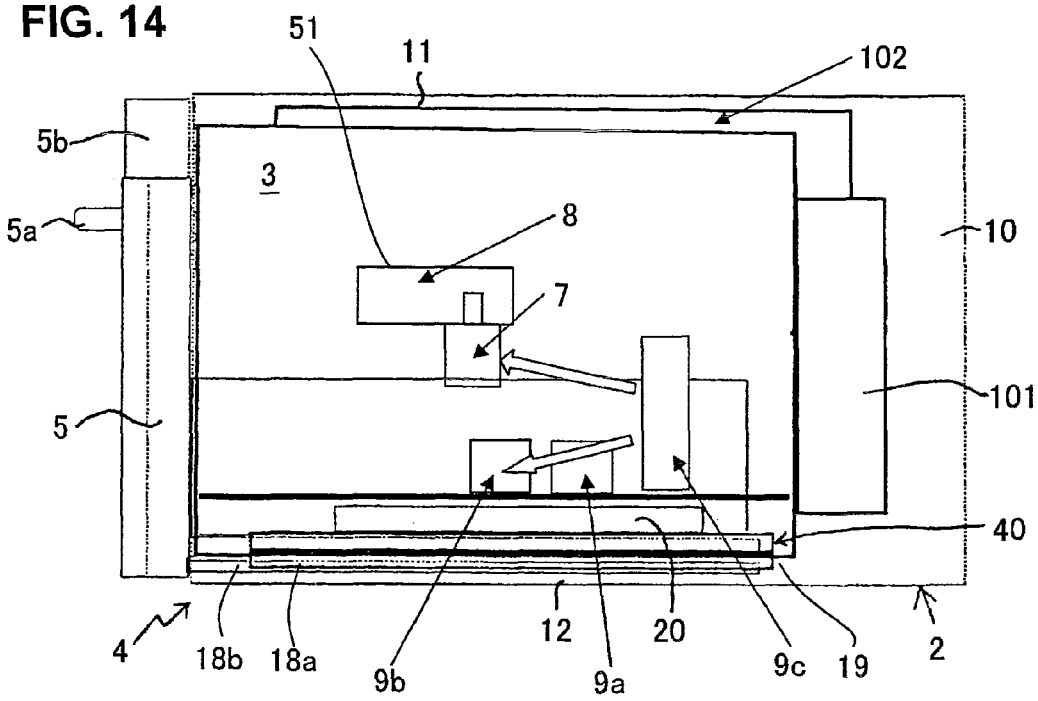
FIG. 14 is a schematic side view of the drawer type cooking device according to FIG. 13, wherein the drawer body is stored in the cooking device body.

FIGS. 13 and 14 are schematic side views of the drawer-type cooking device according to the present invention, wherein FIG. 13 shows a state where the drawer body is drawn out, and FIG. 14 shows a state where the drawer body is stored in the cooking device body. The components equivalent to those illustrated in FIG. 1 or 2 are denoted with the same reference numbers, and the detailed descriptions thereof are omitted. FIGS. 13 and 14 show side views for better understanding of the relative arrangements of elements for illustrating the side wall power supply structure.

In a side wall space 50 (FIG. 1) formed at the outer side portion of the heating chamber 3 and within the cooking device body 2 are disposed electric components composed of power supply units including a magnetron 7, a high pressure transformer 9*a* for supplying power to the magnetron 7 and a high pressure capacitor 9*b*, and a cooling fan 9*c* for blowing air to and cooling the electric components and further sending a portion of the air having cooled the electric components into the heating chamber 3.

Further, a side wall power supply structure 51 composed of a waveguide 8 for introducing the microwaves having been generated by the magnetron 7 into the heating chamber 3 is disposed in the side wall space 50. Since an antenna for outputting the generated microwaves is inserted through an opening formed at a depth portion of the waveguide 8 into the waveguide 8, the microwaves generated by the magnetron 7 can be propagated in the waveguide 8. The microwaves thus introduced through the waveguide 8 are irradiated through the side wall 13 (refer to FIG. 5) of the heating chamber 3 into the heating chamber 3.

In FIGS. 13 and 14, a turntable 20 is rotatably disposed above a bottom wall 17 of the drawer body 4, and a power transmission mechanism 40 (which will be described in detail later) for rotating the turntable 20 is disposed in a space 19 formed between an upper surface of the bottom wall portion 12 of the cooking device body 2 and the bottom wall 17 of the drawer body 4 at the stored state. The fixed rail 18*a* of a slide mechanism 18 is fixed to the cooking device body 2 at the lower portion of the side wall space 50, which supports a movable rail 18*b* mounted on the door 5 in a slidable manner. The weight of the drawer body 4 and the object to be cooked can be supported by the heating chamber 3 via a roller or other means (not shown) at the rear portion, and can be supported by the cooking device body 2 via the movable rail 18*b* through the door 5 at the front portion. Further, a wire structure (not shown) for supplying power, sending and receiving signals and the like for the operation panel 5*b* is arranged along the fixed rail 18*a* and the movable rail 18*b*.

Figure 15:
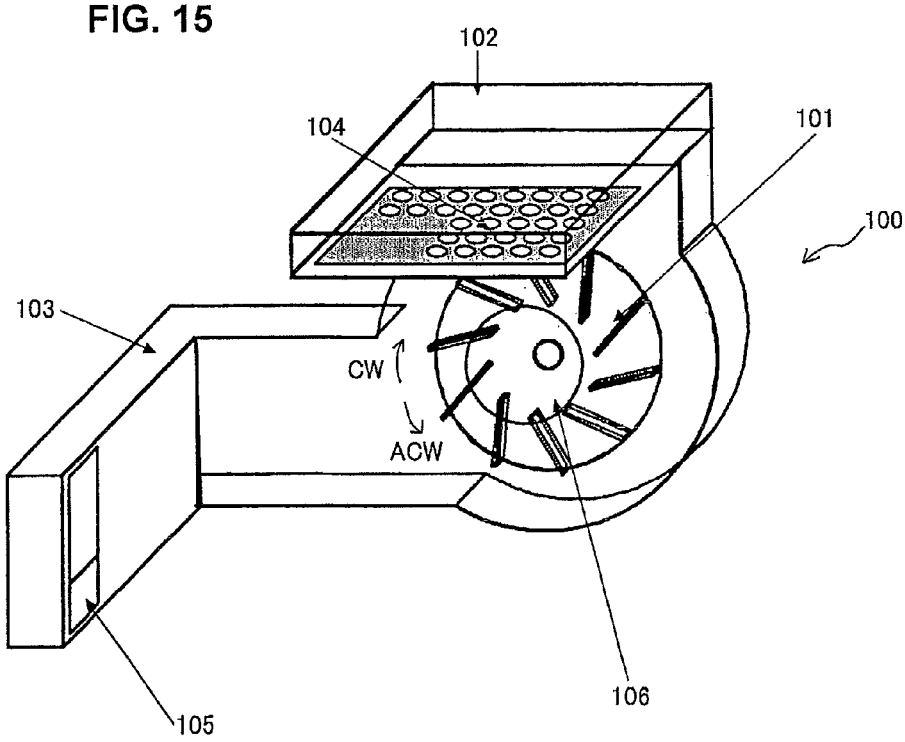
PRIOR ART FIG. 15
FIG. 15 is an explanatory view illustrating the operation principle of a well-known hot-air cooking operation.

Now, with reference to the drawing (FIG. 15), the operation principle of a hot-air heating cooker disclosed in the aforementioned patent document 4 (publication of Japanese Patent No. 3939232) will be described. FIG. 15 is a perspective view showing the outline of a hot-air heating cooker engine unit. As shown in FIG. 15, the hot-air heating cooker engine unit 100 is composed of a centrifugal fan 101 capable of controlling the directions of rotation and the number of rotations, and air blow ducts 102 and 103 branched into two directions. The air blow fan 101 is a centrifugal fan, which is disposed at a rear wall portion 10 (in the space at the rear side of the wall at the depth of the heating chamber).

According to a first hot-air cooking method, the fan 101 is rotated in a counterclockwise direction (ACW), according to which a large amount of air is supplied to the upper duct 102 and a small amount of air is supplied to the side duct 103. The fan 101 is driven at high speed rotation so that the air blowing downward from the upper duct 102 is at a high speed of 50 km/h or higher required for impingement cooking. At this time, the speed of the air flow from the side duct 103 is fairly lower than 50 km/h. Therefore, impingement cooking is performed at the portion where the air flow from the upper duct 102 blows, and normal hot air cooking is performed at the portion where the air flow from the side duct 103 blows.

According to the second hot air cooking method, the fan 101 is rotated in the clockwise direction (CW), and as for the air flow ratio of the upper duct 102 and the side duct 103 compared to the first hot air cooking method, more ratio of air is supplied to the side duct 103 and less ratio of air is supplied to the upper duct 102. The air flow from the upper duct 102 and the side duct 103 is fairly slow with respect to the 50 km/h, and as a whole, hot air cooking close to convection heating is performed. Unlike normal hot air heating cookers, according to the above-mentioned two types of hot air cooking methods, the direction in which hot air is blown from the side duct 103 toward the food is biased, so that food must be rotated via a uniform heating mechanism such as a turntable.

Figure 16:
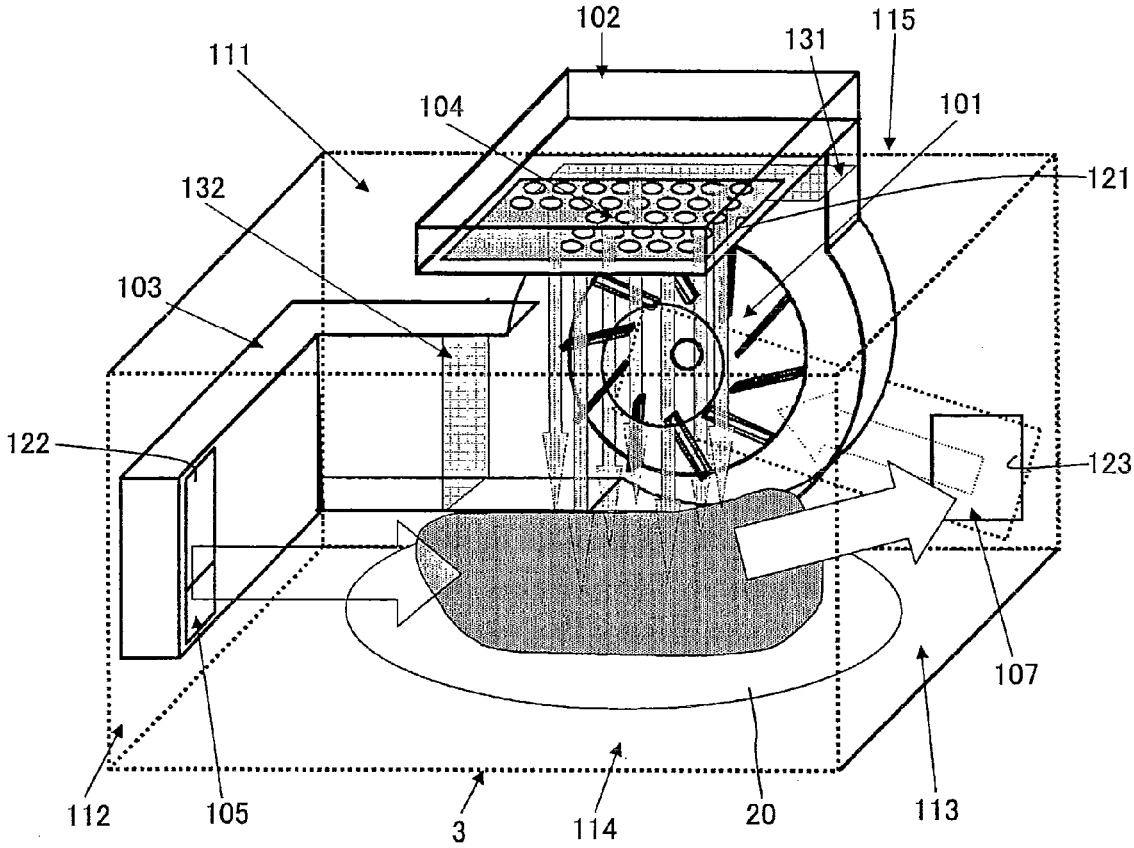
FIG. 16 is an explanatory view illustrating the operation principle of the hot-air cooking operation according to the drawer type cooking device of the present invention.

Next, with reference to FIG. 16, the operation principle of hot air cooking according to the drawer-type cooking device of the present invention will be described. The drawer type cooking device is composed of the drawer type cooking device illustrated in FIG. 15 plus additional structures such as the turntable 20, the upper heater 131 and the side heater 132. Therefore, the drawer type cooking device of the present invention reflects the basic heating/cooking principles of the impingement cooking based on the direction of rotation of the fan of the impingement cooking engine portion 100 and the principles of cooking close to convection heating.

The heating chamber 3 excluding the front side thereof is surrounded by five walls. That is, the heating chamber 3 is surrounded by a heating chamber top wall surface 111 constituting the ceiling wall of the heating chamber 3, a left wall surface 112 and a right wall surface 113 of the heating chamber disposed upright at left and right sides, a heating chamber bottom wall surface 114 supporting a turntable 20 in a rotatable manner, and a depth wall surface 115 of the heating chamber disposed upright at the depth of the heating chamber 3.

The hot air heating engine portion 100 shown in the former drawing is attached to the outer wall of the heating chamber 3 having the turntable 20. The upper duct 102 is bent by 90 degrees so that it extends frontward in contact with the ceiling wall surface, and an opening 121 is formed on the ceiling wall surface 111 of the heating chamber 111 around the center portion of the ceiling wall surface of the heating chamber in correspondence with the upper wall blowout openings 104 of the upper duct 102, through which hot air is blown downward through the opening 121. The side duct 103 is bent by 90 degrees so as to extend frontward in contact with the left side wall surface, and a rectangular opening 122 is disposed substantially at the center of the side wall of the heating chamber in correspondence with the side wall blowout opening 105 formed at the leading end portion of the side wall duct 103 on the left side wall surface of the heating chamber, through which hot air is blown rightward through the opening 122. The casing of the fan 101 has an upper duct 102 connected in the upward direction, and a side duct 103 having a thin rectangular cross-sectional shape connected in the left direction.

An upper heater 131 and a side heater 132 composed of honeycomb heaters or sheathed heaters are provided as heaters to the inner side of the upper duct 102 and the side duct 103. On the other hand, an opening 123 is formed at the lower right corner of the depth wall 115 of the heating chamber, and an air intake duct 107 extending to an intake port 106 of the fan 101 is disposed to the opening 123. In order to improve the circulation of hot air within the heating chamber 3, the opening 123 is disposed at a point close to the antipodal point of the side wall blowout port 105 having the turntable 20 disposed therebetween.

When hot air cooking is performed, the hot air blowing out through the upper blowout ports 104 and the side wall blowout port 105 is converged and reaches the air intake port 106 of the fan 101 through the intake opening 123, constituting a circular air flow. If the upper blowout ports 104 are designed so that air is blown out through the whole ceiling wall surface 111 of the heating chamber, since the air flow blowing downward is of high speed, the relatively slow air flow from the side wall blowout pot 105 is blown downward and cannot heat the side walls and the lower portions of the food, according to which uniform heating is obstructed. In order to solve this problem, a portion of the upper blowout ports 104 is closed near the opening 121 so that only the upper blowout ports 104 superposed with the opening 121 allow air to blow downward, so as not to affect the relatively slow air flow blown from the side wall blowout port 105.

According to the prior art, the microwaves generated via the magnetron is irradiated into the heating chamber via the waveguide disposed on the ceiling structure, and a rotary antenna for agitating the microwaves is disposed within the waveguide, so that it was difficult to adopt the hot air cooking structure using the ceiling structure as duct. However, according to the present invention, a turntable 20 disposed on the bottom wall of the drawer body without using the ceiling structure is disposed as the uniform heating structure while adopting a side wall power supply structure 51 arranging the waveguide 8 in the side wall space 50 of the heating chamber, so that high speed hot air cooking function using a fan 101 and ducts 102 and 103 can be adopted in the cooking device body 2. According to the present embodiment, the ceiling structure is not used for the uniform heating structure, and the slide mechanism of the drawer body 2 is moved to the lower portion of the cooking device body 2, while the remaining space composed of the heating chamber ceiling wall surface 111 and left and right side walls of the heating chamber have heat insulating materials attached thereto. According to the present embodiment, the operation panel 5*b* is moved to the upper portion of the door 5, but it can also be disposed at the upper portion of the main body, similar to the prior art drawer type cooking devices.

When the fan 101 is rotated at high speed in the counterclockwise direction, high speed air flow is blown downwards toward the upper surface of the food through the upper blowout ports 104 on the ceiling wall surface 111 of the heating chamber, thereby enabling to cook the food via impingement cooking. At the same time, relatively slow flow of hot air is blown from the side toward the lower portion of the food through the side wall blowout port 105 on the side wall 112 of the heating chamber, by which auxiliary heating compensating for the lack of heating of the lower portion of the food not subjected to impingement cooking is performed. Furthermore, when the fan 101 is rotated at low speed in the clockwise direction, relatively slow flow of hot air is blown toward the food from the ceiling wall surface 111 of the heating chamber and the side wall surface 112 of the heating chamber, according to which cooking close to convection heating is enabled. According to both heating methods, the food is rotated on the turntable 20 during heating, so uniform heating of food becomes possible.

Patent document 4 (Japanese Patent No. 3939232) discloses a high speed hot air heating cooker that the present applicant provided to the market, but since it is designed mainly with the aim to reduce the cooking time of a relatively large amount of meat or the like to a speed comparable to the cooking time of gas heating cookers, the heating cooker is large-sized having a heating chamber ceiling height of 30 cm or higher and an inner volume of over 40 L, with a consumption power as high as 2000 W. Accordingly, the built-in installation of such large-sized high speed hot air heating cooker is not easy since the external dimension thereof is irregular and heat-radiation cooling is difficult. Thus, the heating cooker is normally disposed in an open space on a countertop.

On the other hand, due to the limitation in the space to which the cooking device is to be built in, the drawer type cooking device according to the present invention must perform impingement cooking with reduced consumption power.

According to the drawer type cooking device of the present invention, the heating chamber ceiling height is approximately 20 cm or smaller, and the heating chamber inner volume is small, not greater than approximately 25 L. Therefore, according to the first hot air cooking method mentioned above, even if the wind speed of hot air is equivalent, the heat quantity required for cooking is reduced, by which the cross-sectional area of the air duct can be reduced and the hot air flow quantity can be reduced. Further, since the distance between the hot air blowout ports on the ceiling wall and the food is short, the heating efficiency is high, so that even if the cooking device performs impingement cooking, the overall heating power can be reduced to approximately ½.

According to the second hot air heating method mentioned above, the high speed hot air heating cooker disclosed in patent document 4 (Japanese Patent No. 3939232) assumes placing a loading stage on the turntable and mounting food on two stages for cooking. On the other hand, the drawer type cooking device according to the present invention mounts food only on a single stage on the loading stage placed on the turntable, so as to reduce the heating power to approximately ½.

Figure 17:
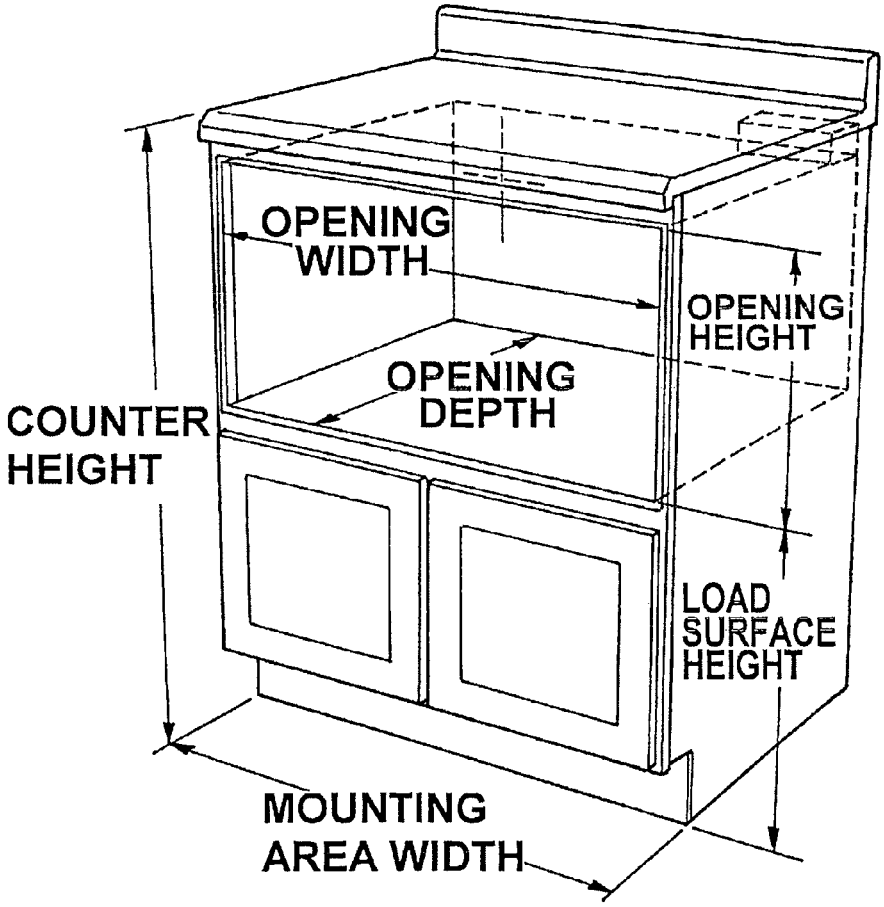
PRIOR ART FIG. 17

The present invention realizes reduction of size and heating power, according to which the consumption power of the device becomes equivalent to that during microwave heating, and except for the fact that the time required for heating and cooking is longer compared to microwave heating and cooking, air intake and exhaust including heat radiation of the present device is enabled according to a similar exhaust air cooling structure as that of the prior art drawer type microwave ovens, according to which the built-in installation of a high-speed hot air cooking device, which had been difficult according to the prior art, is enabled for the first time. According to the drawer-type cooking device of the present invention, it is preferable to have a wider side wall space in order to support the air flow duct such as the side wall duct, attach heat insulating material, store electric components, and to ensure air cooling. Therefore, as shown in FIG. 17, it is assumed that the cabinet structure suitable for built-in installation of the drawer type cooking device is the cabinet structure of the wider type out of the two standard sizes.

The hot air cooking function of the drawer type cooking device according to the present invention has an equivalent consumption power during cooking as the consumption power of the microwave cooking operation, due to the reduction of heating power by the reduced size and reduced heating load of the present device, and when the present device is stored in a space having an outer dimension similar to the prior art drawer type microwave oven, electric components can be cooled and cooking heat can be discharged by the improvement in the design of the air cooling structure and the like. Therefore, the present invention responds to the demands of consumers by providing a high-speed hot air cooking device to be built into a kitchen, which was not possible according to the prior art.

Furthermore, the composite cooking function of the present invention enables the drawer type cooking device to perform the cooking operation that had been conventionally performed by other cooking devices in the kitchen, by which the operation of the various cooking devices can be leveled and the overall time required for cooking can be reduced, and the present invention preferably responds to the demands of consumers in this manner.

What is claimed is:

1. A drawer type cooking device having a drawer body capable of being stored in and drawn out of a cooking device body having a heating chamber formed in an interior thereof, wherein a door of the drawer body closes a front side opening of the heating chamber when the drawer body is at a stored position; the cooking device comprising:

a turntable supported rotatably on a bottom wall of the drawer body;

a motor disposed outside the heating chamber at a bottom wall portion of the cooking device body; and a power transmission mechanism disposed between the bottom wall portion of the cooking device body and the bottom wall of the drawer body, being engaged when the drawer body is pushed into the cooking device body and disengaged when the drawer body is drawn out of the cooking device body, capable of transmitting a rotation of the motor to the turntable when engaged;

the power transmission mechanism comprising:

a first transmission unit attached to an output shaft of the motor passing through the bottom wall portion of the cooking device body and protruding into the heating chamber;

a second transmission unit attached to a rotation shaft of the turntable passing through the bottom wall of the drawer body and protruding into the heating chamber; and a sector-type transmission unit disposed pivotally on the cooking device body, constituting a first engagement portion on an outer radial side being engaged with the power transmission unit and also constituting a second engagement portion on an inner radial direction opening toward a draw-out direction of the drawer body and engaging with the second transmission unit when the drawer body is at a stored state.

2. The drawer type cooking device according to claim 1, wherein the first transmission unit is an output gear attached to the output shaft of the motor, and the second transmission unit is a drive gear attached to the rotation shaft of the turntable, and the sector-type transmission unit is a sector gear supported pivotally on a pivot axis disposed on the cooking device body, the sector gear having an arced externally-toothed gear portion capable of engaging with the output gear and an arced internally-toothed gear portion capable of engaging with the drive gear.

3. The drawer type cooking device according to claim 2, wherein the motor is disposed at one depth corner portion at the bottom wall portion of the cooking device body, and the pivot axis of the sector gear is disposed so that the rotation shaft of the turntable is placed between the output shaft of the motor and the pivot axis when the drawer body is at the stored state, and is positioned so as not to interfere with the drive gear passing by when the drawer body is being drawn out or stored.

4. The drawer type cooking device according to claim 2 or claim 3, wherein the externally-toothed gear portion has a radius substantially equal to the turntable, and the internally-toothed gear portion and the drive gear are engaged at a gear reduction ratio so that the turntable is rotated for a single rotation by the pivoting movement of the sector gear within the mechanically pivotable angle range.

5. The drawer type cooking device according to claim 1, wherein the first transmission unit, the second transmission unit and the sector-type transmission unit are formed by attaching a plastic toothed belt on a surface of a circular-arced elastic body.

6. The drawer type cooking device according to claim 1, wherein the first transmission unit, the second transmission unit and the sector-type transmission unit are formed of friction wheels having circumferential or circular-arc surfaces with a high friction coefficient and engaged to each other via friction.

* * * * *